US009896862B1

(12) United States Patent
Cox

(10) Patent No.: US 9,896,862 B1
(45) Date of Patent: Feb. 20, 2018

(54) TENT AND CANOPY APPARATUS

(71) Applicant: Brian P. Cox, San Diego, CA (US)

(72) Inventor: Brian P. Cox, San Diego, CA (US)

( * ) Notice: Subject to any disclaimer, the term of this patent is extended or adjusted under 35 U.S.C. 154(b) by 0 days.

(21) Appl. No.: 14/109,925

(22) Filed: Dec. 17, 2013

Related U.S. Application Data

(60) Provisional application No. 61/738,995, filed on Dec. 18, 2012.

(51) Int. Cl.
*E04H 15/28* (2006.01)
*E04H 15/32* (2006.01)

(52) U.S. Cl.
CPC ..... *E04H 15/28* (2013.01); *E04H 15/322* (2013.01)

(58) Field of Classification Search
CPC ..... E04H 15/28; E04H 15/322
USPC ..... 135/121, 135, 147, 98
See application file for complete search history.

(56) References Cited

U.S. PATENT DOCUMENTS 344,094 A * 6/1886 Fosburgh ..... A45B 23/00 135/21
1,823,386 A * 9/1931 Brust ..... E04H 15/28 135/120.2
2,771,087 A * 11/1956 Simonson ..... E04H 15/28 135/126
2,864,389 A * 12/1958 Smith ..... E04H 15/28 135/120.2
3,376,879 A * 4/1968 Huddle ..... E04H 15/18 135/121
4,202,363 A * 5/1980 Watts ..... E04H 15/28 135/126
4,304,068 A * 12/1981 Beder ..... A01G 13/043 135/117
5,479,954 A * 1/1996 Lin ..... E04H 15/28 135/27
5,871,026 A * 2/1999 Lin ..... E04H 15/28 135/120.3
6,021,796 A * 2/2000 Vavra ..... E04H 15/16 135/121
6,776,177 B2 * 8/2004 Wu ..... E04H 15/40 135/135
6,802,329 B2 * 10/2004 Chen ..... E04H 15/48 135/135
6,854,476 B1 * 2/2005 Chai ..... E04H 15/48 135/135
7,185,666 B2 * 3/2007 Chai ..... E04H 15/48 135/135
7,406,977 B1 * 8/2008 Shires ..... E04H 15/26 135/115
7,802,582 B2 * 9/2010 Livacich ..... E04H 15/44 135/126

(Continued)

*Primary Examiner* — Noah C. Hawk
(74) *Attorney, Agent, or Firm* — Steven C. Tietsworth, Esq.

(57) ABSTRACT

A tent including a pull hub is disclosed. The pull hub may be a side pull hub that may include a pull cord having a distal end and a proximal end coupled to the hub, an upper hub element, and a lower hub element. The tent may further include a plurality of tent support poles coupled to the hub. The tent may further include a fabric material coupled to the support poles. The side-pull hub may include an opening on a side of the hub through which the distal end of the pull cord is passed through to facilitate tent erection by moving the upper and lower hub element together upon user actuation.

16 Claims, 21 Drawing Sheets

Example Embodiment of Tent (Blind) With Expansion Volume Supported by Expansion Pole Structure Example Embodiment of Alternate Side-Pull Hub

(56) References Cited

U.S. PATENT DOCUMENTS

| | | | | |
|---|---|---|---|---|
| 2004/0099301 | A1* | 5/2004 | Zhang | A47C 29/006 135/135 |
| 2004/0159346 | A1* | 8/2004 | Huang | A01G 9/16 135/98 |
| 2005/0224107 | A1* | 10/2005 | Yang | E04H 15/48 135/135 |
| 2006/0162756 | A1* | 7/2006 | Gao | E04H 15/28 135/98 |
| 2006/0231129 | A1* | 10/2006 | Ferraro, Sr. | E04H 15/48 135/135 |
| 2012/0195682 | A1* | 8/2012 | Zhou | E04H 15/48 403/345 |
| 2013/0074895 | A1* | 3/2013 | Zimmer | E04H 15/28 135/98 |
| 2014/0069476 | A1* | 3/2014 | Zimmer | E04H 15/28 135/98 |
| 2014/0261603 | A1* | 9/2014 | Leblanc | E04H 15/28 135/147 |

* cited by examiner

Example Tent Embodiment

Example Canopy or "Pop-Up" Tent Embodiment

*Example Tent Hub in Erected Position*
*(PRIOR ART)*

*Example Tent Hub in Take Down Position (PRIOR ART)*

*Example Tent Hub with Extentable Rib Segment in Erected Position*

*Example Tent Hub Embodiment with Extentable Pole/Rib Segment in Erected Position, Top View*

*Example Tent Hub Embodiment with Multiple Expandable Pole Sections in Erected Position, Top View*

Example Tent Hub with Extentable Pole Deployed

*Example Embodiment of Tent (Blind) With Expansion Volume Supported by Expansion Pole Structure*

*Example Canopy or "Pop-Up" Tent Embodiment (Front Side View) with Angled, Jointed Legs for Use on Angled Surface*

*Example Angle-Adjustable Canopy Leg Joint in Angled Position*

*Example Angle-Adjustable Canopy Leg Joint in Vertical Position*

Example Angle-Adjustable Canopy Leg Hinge Joint Embodiment, Front View

Example Angle-Adjustable Canopy Leg Hinge Joint Embodiment in Angled Position

Example Angle-Adjustable Canopy Leg Hinge Joint Embodiment in Vertical Position

*Example Canopy or "Pop-Up" Tent Embodiment (Back Side View) with Canopy Airflow Opening*

Example Embodiment of Joint with Integrated Guy-Line Support

*Example Embodiment of Side Pull Hub*

*Cross-Section of Side Pull Hub of FIG. 10*

*Example Embodiment of Alternate Side Pull Hub*

*Example Embodiment of Alternate Side-Pull Hub*

*Example Embodiment of Alternate Side Pull Hub*

*Example Embodiment of Alternate Side-Pull Hub*

*Example Embodiment of Side Pull Hub Internal Mechanism with Lower Hub Element Pull Cable Exit*

*Example Embodiment of Adjustable Canopy/ Gazebo Foot With Ball Joint*

TENT AND CANOPY APPARATUS

CROSS-REFERENCE TO RELATED APPLICATIONS

This application claims priority under 35 U.S.C. § 119(e) to U.S. Provisional Patent Application Ser. No. 61/738,995, entitled TENT AND CANOPY APPARATUS, filed Dec. 18, 2012, the content of which is incorporated by reference herein in its entirety for all purposes.

FIELD

This disclosure relates generally to portable tents and canopies. More specifically, but not exclusively, the disclosure relates to tents and canopies along with components for use on such tents or canopies, including novel tent or canopy legs, joints, tops, and hubs.

BACKGROUND

Tents and canopies have been known in the art and used for centuries. More recent tent designs have focused on weight reduction as well as ease of opening and erection, as well as quick disassembly and storage.

However, as uses of tents and canopies continue to increase and additional applications develop, the demand for additional flexibility in configuration, assembly, and functionality continues to grow. Consequently, there is an ongoing need in the art for improved tent and canopy apparatus for existing as well as new camping, recreational, and commercial applications.

SUMMARY

This disclosure relates generally to portable tents and canopies. More specifically, but not exclusively, the disclosure relates to tents and canopies along with components for use on such tents or canopies, including novel tent or canopy legs, joints, tops, and hubs.

In one aspect, the disclosure relates to a tent or canopy or shade structure. The tent may include, for example, a side pull hub. The side pull hub may include a pull cord having a distal end and a proximal end coupled to the hub, an upper hub element, and a lower hub element. The tent may further include a plurality of tent support poles coupled to the hub. The tent may further include a fabric material coupled to the support poles. The side-pull hub may include an opening on a side of the hub through which the distal end of the pull cord is passed through to facilitate tent erection by moving the upper and lower hub element together upon user actuation.

In another aspect the disclosure relates to a tent or canopy or shade structure. The tent may include, for example, a hub including a pull cord, an upper hub element, and a lower hub element. The tent may further include a plurality of tent support poles coupled to the hub, and one or more expansion poles coupled to the hub. The tent may further include a fabric or other cover or outer material coupled to the support poles. The fabric material may include a core tent section and an expansion section.

In another aspect, the disclosure relates to a tent or canopy or shade structure. The canopy may include, for example, a frame, a canopy fabric disposed on the frame, and one or more angle adjustable legs, including angle adjustable leg joints, coupled to the frame. The canopy may include two adjustable legs and two straight telescoping legs. Alternately, the canopy may include four or more angle adjustable legs.

In another aspect, the disclosure relates to a tent or canopy or shade structure. The canopy may include, for example, a frame and a canopy fabric disposed on the frame. The canopy fabric may include one or more airflow openings.

In another aspect, the disclosure relates to a tent or canopy or shade structure. The tent may include, for example, a hub, a pull cord having a distal end and a proximal end coupled to the hub, a plurality of tent support poles coupled to the hub, a fabric material coupled to the support poles, and one or more joints coupled to the tent support poles, the joints including a tie out. The tent may further include a guy line having a proximal end coupled to the tie out and a distal end for coupling to a ground stake or other ground or surface attachment element.

Various additional aspects, features, and functionality are further described below in conjunction with the appended Drawings.

BRIEF DESCRIPTION OF THE DRAWINGS

The present disclosure may be more fully appreciated in connection with the following detailed description taken in conjunction with the accompanying drawings, wherein.

DETAILED DESCRIPTION OF EMBODIMENTS

Figure 1:
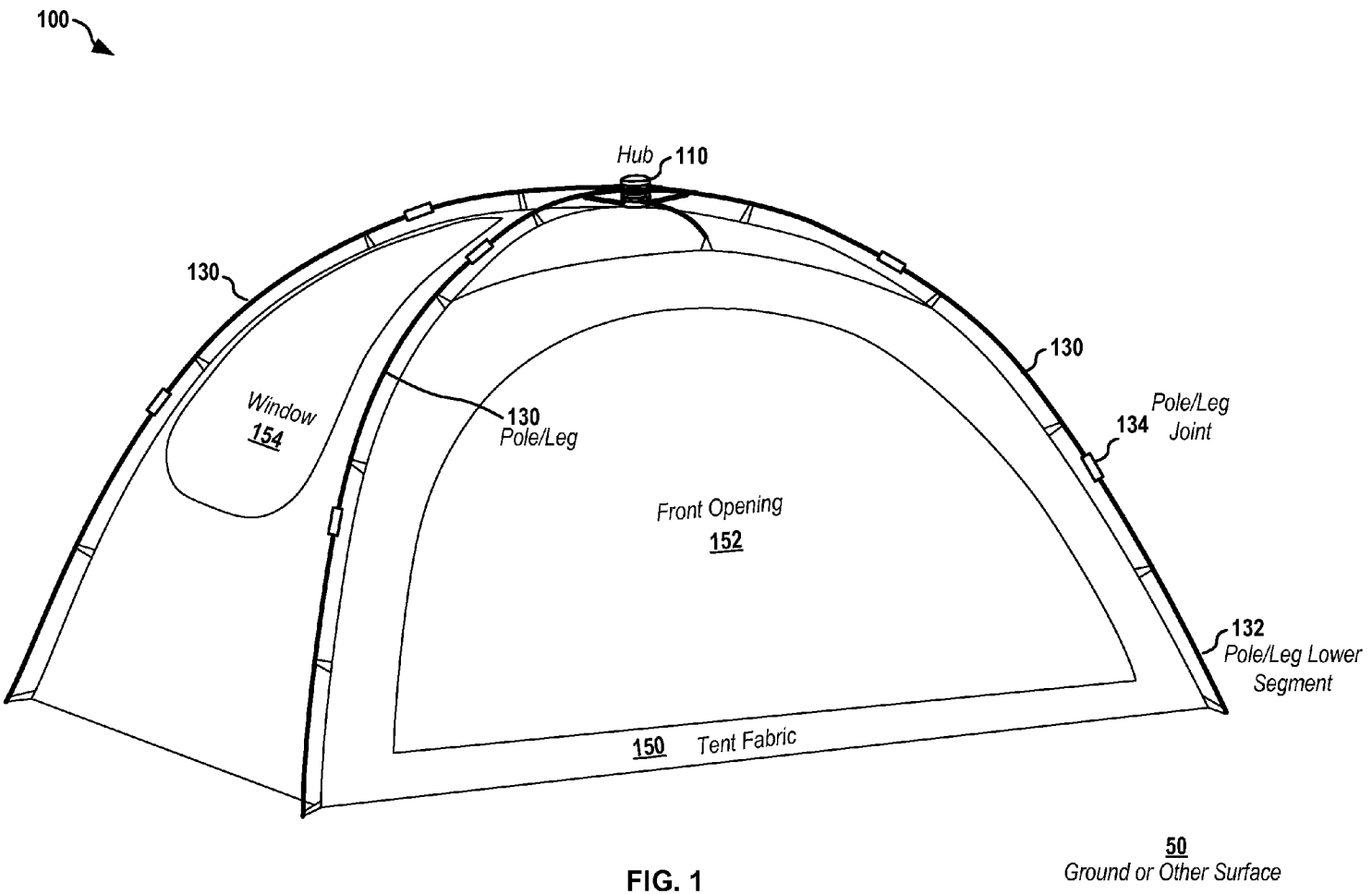
FIG. 1 illustrates details of an embodiment of an example tent on which aspects of the disclosure may be implemented.

This disclosure relates generally to portable tents and canopies. More specifically, but not exclusively, the disclosure relates to tents and canopies along with components for use on such tents or canopies, including novel tent or canopy legs, joints, tops, and hubs.

In one aspect, the disclosure relates to a tent or canopy may include a novel hub having a coupling element to attach an expandable pole to the hub for structural support for an expansion frame structure of the tent.

In another aspect, the disclosure relates to a canopy including a joint and/or leg structure configured to allow a portion of one or more of the canopy legs to angle when used on a non-level surface, such as on a hill, bleachers, sporting event stands, or other non-level surfaces.

In another aspect, the disclosure relates to a canopy including a top element having an airflow opening to allow air to flow through the canopy when placed on a non-level structure such as a hill, bleachers, sporting event stands, or other non-level surfaces.

In another aspect, the disclosure relates to a tent or canopy joint including an integral tie-out for attachment of a guy-line or other supporting element between the joint and a tent or canopy fabric or other surface or frame structure.

In another aspect, the disclosure relates to a tent or canopy hub including a side-pull configuration for rapid disassembly of the tent for transportation or storage.

In another aspect, the disclosure relates to a tent or canopy or shade structure. The tent may include, for example, a side pull hub. The side pull hub may include a pull cord having a distal end and a proximal end coupled to the hub, an upper hub element, and a lower hub element. The tent may further include a plurality of tent support poles coupled to the hub. The tent may further include a fabric material coupled to the support poles. The side-pull hub may include an opening on a side of the hub through which the distal end of the pull cord is passed through to facilitate tent erection by moving the upper and lower hub element together upon user actuation.

The opening on a side of the hub may, for example, be in the upper hub element. The opening on the side of the hub may be in the lower hub element. The opening on the side of the hub may be rounded and/or curved and/or smoothed to reduce abrasion on the pull cord during user actuation. The one or both of the upper and lower hub elements may include a palm grip to facilitate tent erection and/or take-down.

The tent may further include, for example, one or more joints coupled to the tent support poles. The one or more joints may include a tie out. The tent may further include a guy line having a proximal end coupled to the tie out and a distal end for coupling to a ground stake or other ground or surface attachment element.

In another aspect the disclosure relates to a tent or canopy or shade structure. The tent may include, for example, a hub including a pull cord, an upper hub element, and a lower hub element. The tent may further include a plurality of tent support poles coupled to the hub, and one or more expansion poles coupled to the hub. The tent may further include a fabric or other cover or outer material coupled to the support poles. The fabric material may include a core tent section and an expansion section.

The one or more expansion poles may, for example, be coupled to the upper hub element and directed upward and/or outward from the hub to support the expansion section of the fabric material at a height greater than or equal to the hub height when the tent is erected. The hub may include a coupling connection for the one or more expansion poles and the support poles, wherein the tent support poles are coupled to the upper and lower hub elements and the expansion poles are coupled only to the upper hub element or an upper area of the hub. The tent may include two expansion poles. The expansion section may include an opening and one or more windows. The opening and/or one or more windows may be at a front side or area of the tent. The tent may be configured as a blind. The blind may include a camouflage or similar fabric material.

In another aspect, the disclosure relates to a tent or canopy or shade structure. The canopy may include, for example, a frame, a canopy fabric disposed on the frame, and one or more angle adjustable legs, including angle adjustable leg joints, coupled to the frame. The canopy may include two adjustable legs and two straight telescoping legs. Alternately, the canopy may include four or more angle adjustable legs.

The angle adjustable leg joints may, for example, be positioned approximately in the center of the one or more angle adjustable legs. One or more of the angle adjustable leg joints may alternately be positioned approximately at the top of the one or more angle adjustable legs. The angle adjustable leg joints may include a ball and socket joint and/or a hinged joint or other joint mechanism. The angle adjustable legs may include a telescoping section.

The canopy may further include, for example, one or more airflow openings in the canopy fabric.

The canopy may further include, for example, one or more adjustable feet coupled to the one or more angle adjustable legs. The canopy may further include one or more straight legs and one or more adjustable feet coupled to the one or more straight legs. The adjustable foot may include a ground plate. The adjustable foot may include a ball and/or hinged joint.

In another aspect, the disclosure relates to a tent or canopy or shade structure. The canopy may include, for example, a frame and a canopy fabric disposed on the frame. The canopy fabric may include one or more airflow openings.

The canopy may further include, for example, one or more angle adjustable legs coupled to the frame. The legs may include two angle adjustable legs and two straight telescoping legs. The legs may include four or more angle adjustable legs. The angle adjustable leg joints may be positioned approximately in the center of the one or more angle adjustable legs. Alternately, one or more of the angle adjustable leg joints may be positioned approximately at the top of the one or more angle adjustable legs. The angle adjustable leg joints may include a ball and socket joint and/or a hinged joint. The angle adjustable legs may include a telescoping section.

The canopy may further include, for example, one or more adjustable feet coupled to the one or more angle adjustable legs. The canopy may further include one or more straight legs and one or more adjustable feet coupled to the one or more straight legs. The adjustable foot may include a ground plate. The adjustable foot may include a ball and/or hinged joint.

In another aspect, the disclosure relates to a tent or canopy or shade structure. The tent may include, for example, a hub, a pull cord having a distal end and a proximal end coupled to the hub, a plurality of tent support poles coupled to the hub, a fabric material coupled to the support poles, and one or more joints coupled to the tent support poles, the joints including a tie out. The tent may further include a guy line having a proximal end coupled to the tie out and a distal end for coupling to a ground stake or other ground or surface attachment element.

Various additional aspects and details are described below in conjunction with the appended Drawings.

Tents and canopies have been well known and used in the art for centuries. More recent tent innovations relate to features such as decreased weight, fast opening (erection) and closing for storage. Some example fast opening tents are described in, for example, Lin, U.S. Pat. No. 5,479,954, as well as Joo-Tai, United States Patent Application Publication 2007/0062569.

Prior at tents typically include a frame structure with a tent fabric supported thereon. The fabric may be secured to the inside or outside of the frame. Typical frames include multiple elongated ribs coupled to a hub, typically, on the top of the tent, with the ribs radiating out from the hub towards the ground or other surface.

To assist in opening or erecting these tents, the frame typically includes a cord having one end secured to a lower portion of the hub. The tent is erected by pulling on the cord, which moves the lower hub element upward towards an upper hub element. Traditional tent hubs have used top or bottom pull configurations for disassembly.

The arm and hub configuration of prior art tents provided a frame to support a dome-like tent structure, however, existing tent and canopies have various deficiencies which may be addressed through embodiments of the various aspects described herein.

Turning to FIG. 1, an example tent 100, on which various embodiments as described herein may be implemented, is illustrated. Tent embodiment 100 includes a hub 110, which may be configured to allow rapid erection of tent 100 for use or disassembly for transport, storage, etc. Tent 100 includes a fabric or plastic skin 150, which is attached to a frame structure including poles or legs, joints, and one or more hubs. For example, multiple pole segments, such as segment 132, may be coupled by joints 134 to form a leg 130. A typical tent has three or more legs in various configurations.

The fabric 150 may include one or more openings, such as a front opening 152 as shown, as well as one or more windows 154, vents (not shown) or other windows, doors, or openings (not shown). A tent such as tent 100 is typically erected on the ground 50, but may also be erected on other surfaces such as paved areas, bleachers, or other surfaces, which may be either flat (level) or non-level.

Figure 2:
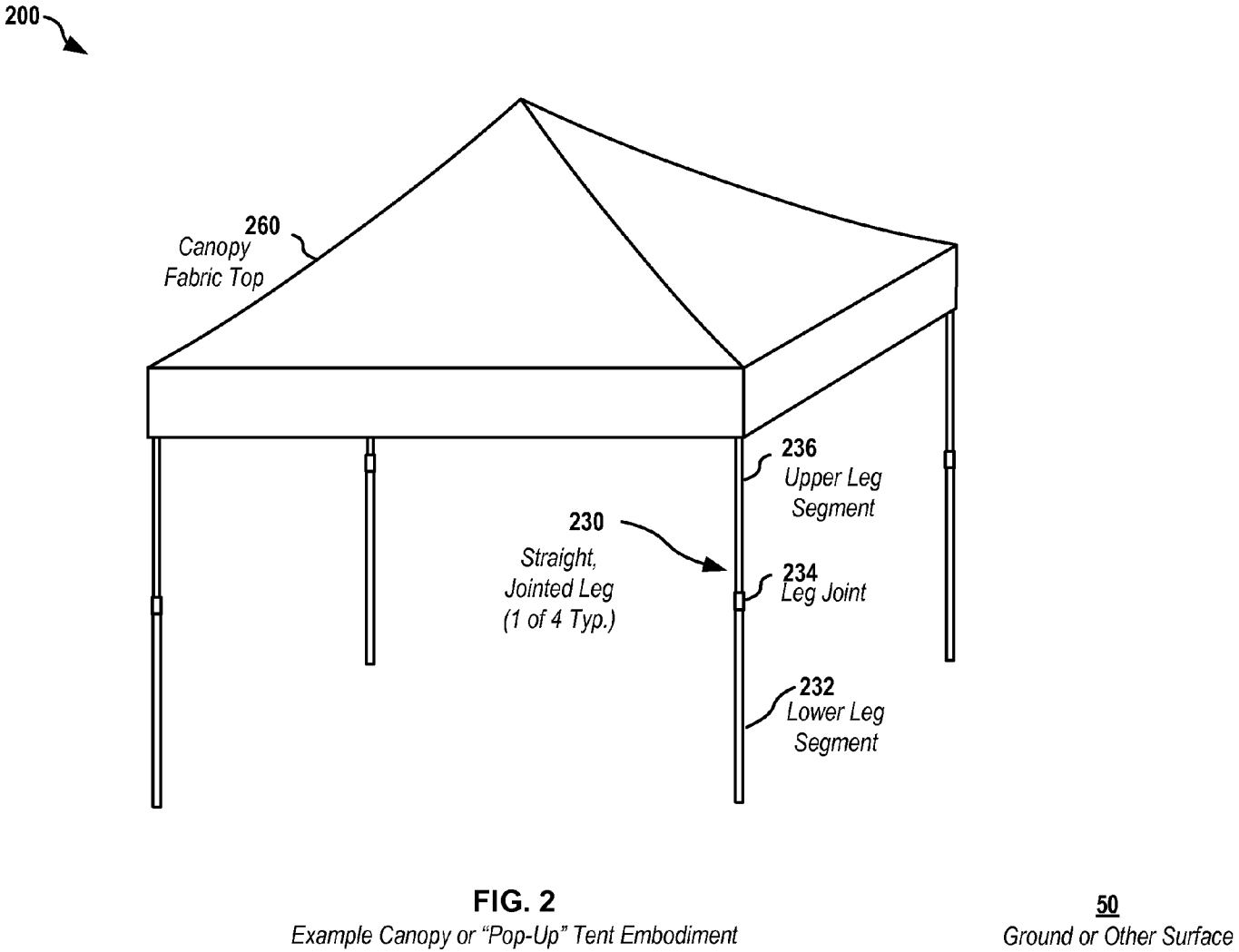
FIG. 2 illustrates details of an embodiment of a canopy on which aspects of the disclosure may be implemented.

FIG. 2 illustrates details of an example embodiment 200 of a canopy on which various aspects as described subsequently herein may be implemented. Canopy 200 may include a top 360, which is typically a fabric or plastic material, with the top mounted on a frame structure including a plurality of legs. For example, as shown in FIG. 2, fabric top 260 may be attached to a frame including four legs 230, which may be straight and jointed as shown or, as described subsequently herein, may be angled for better support of the canopy on a non-level surface. Legs 230 may include two or more leg segments, such as upper leg segment 236 and lower leg segment 232, which may be coupled by a leg joint 234 to allow the leg segments to be raised or lowered. As with tent embodiment 100, canopy embodiment 200 may be mounted on a flat, level surface, or, as described subsequently herein, may be configured to provide improved structural support on non-level surfaces and/or a reduced sail area profile when subjected to winds.

In one aspect, tent and canopy embodiments such as are shown in FIGS. 1 and 2 may include joint fabricated entirely or partially of a strong but somewhat pliable material or coating, such as thermoplastic urethane (TPU) or other similar materials. This may be done to reduce the chance of the joint damaging the tent fabric, storage bags, and the like by reducing hard edges and surfaces.

Figure 3A:
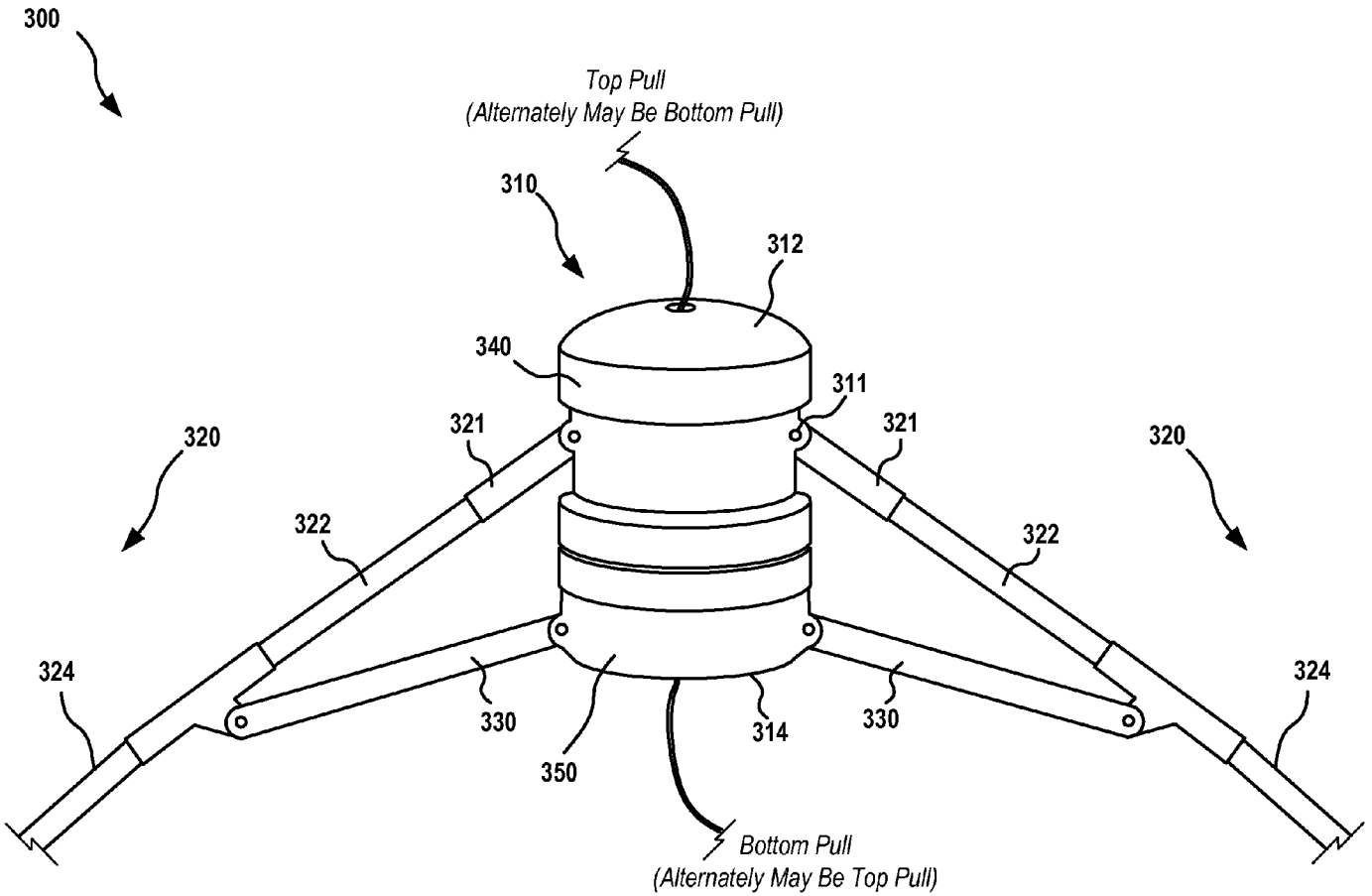
FIGS. 3A & 3B illustrate an example prior art hub configuration.
Figure 3B:
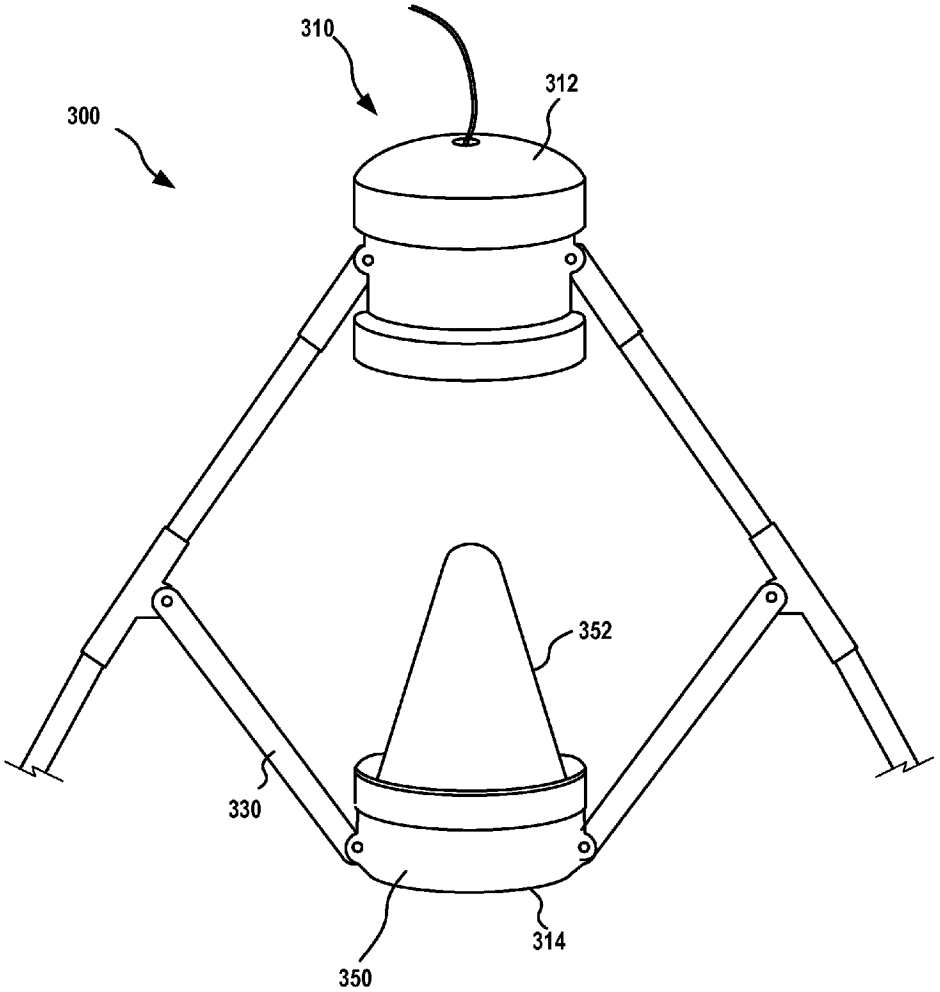

In one aspect, this disclosure relates to a novel hub configuration that may be used on a tent or canopy such as those shown in FIG. 1 or 2. FIG. 3A illustrates a tent frame hub and pole structure 300 including an example prior art hub 310 comprising an upper hub element 312 and a lower hub element 314, along with coupling elements 320 for attachment to a pole segment 322 via a screw, bolt, or pin 311. A lower support element 330 may be flexibly coupled to the lower hub element 314 as shown to provide enhanced structural support for poles or legs 324 radiating outward from the hub 310. A hub such as hub 310 may be used to join three or four pole segments 324 in a tent such as tent 100 as shown in FIG. 1. FIG. 3B illustrates the hub of FIG. 3A in a take down or retracted position. A cone structure 352 or other similar structure may be used to join the upper and lower hub elements when the tent is erected and the hub is in the upright and locked position.

Figure 4A:
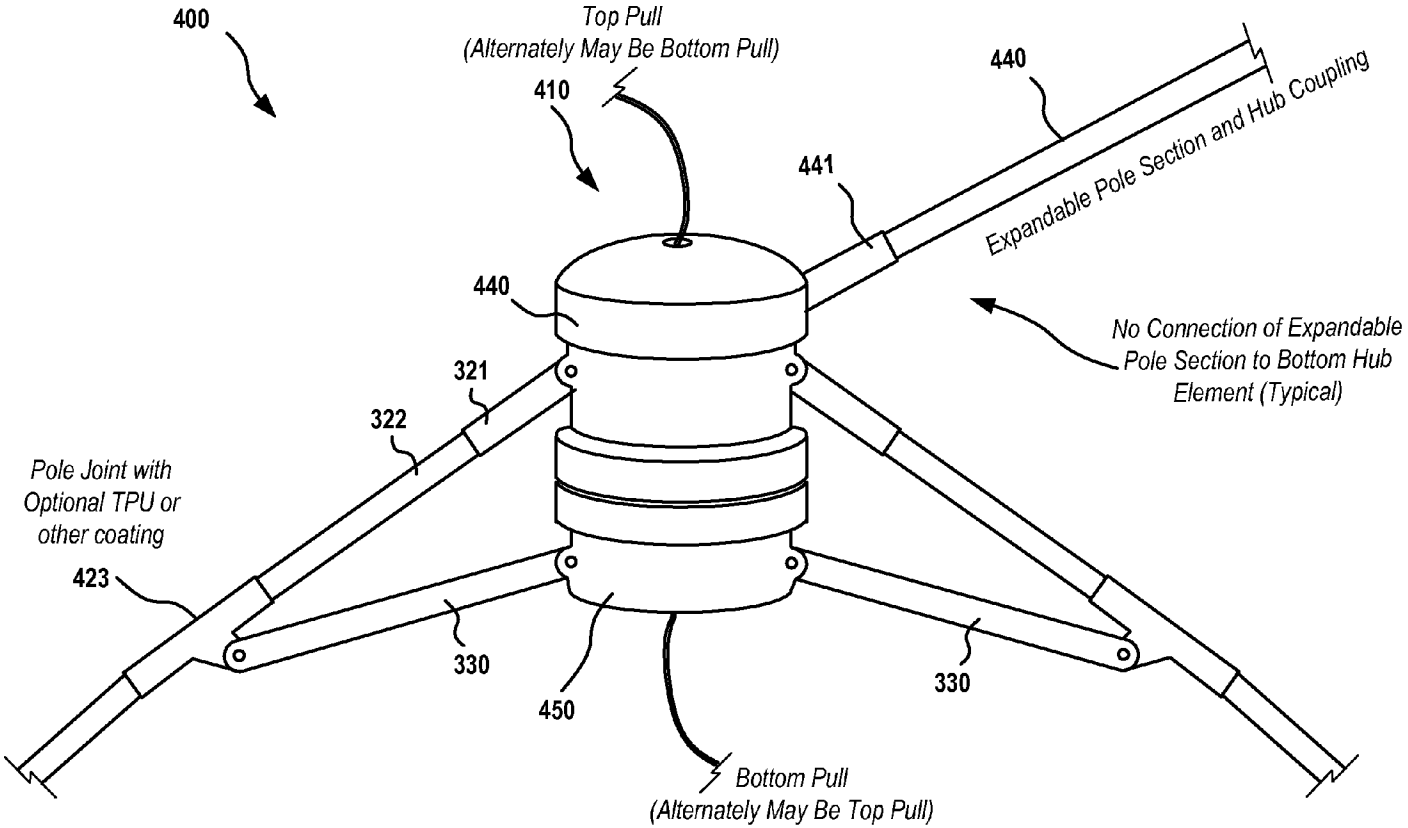
FIG. 4A-4C illustrate details of an embodiment of a hub with an expandable pole coupling in accordance with certain aspects of the disclosure.
Figure 4B:
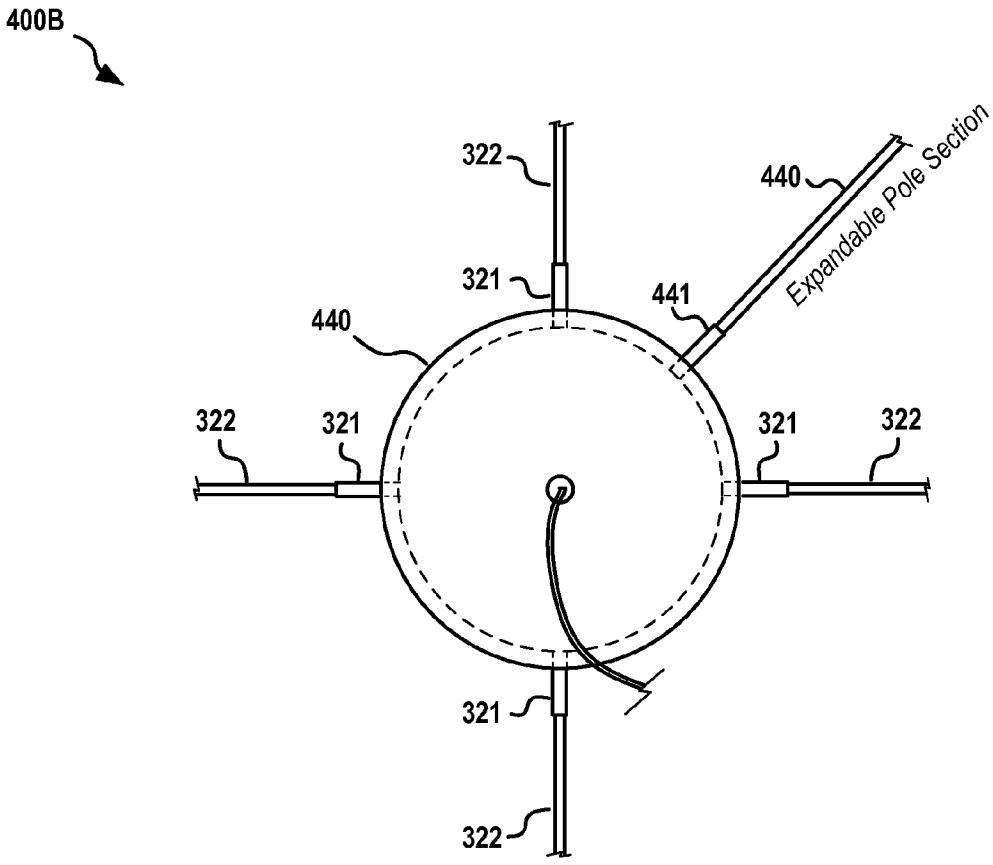
Figure 4C:
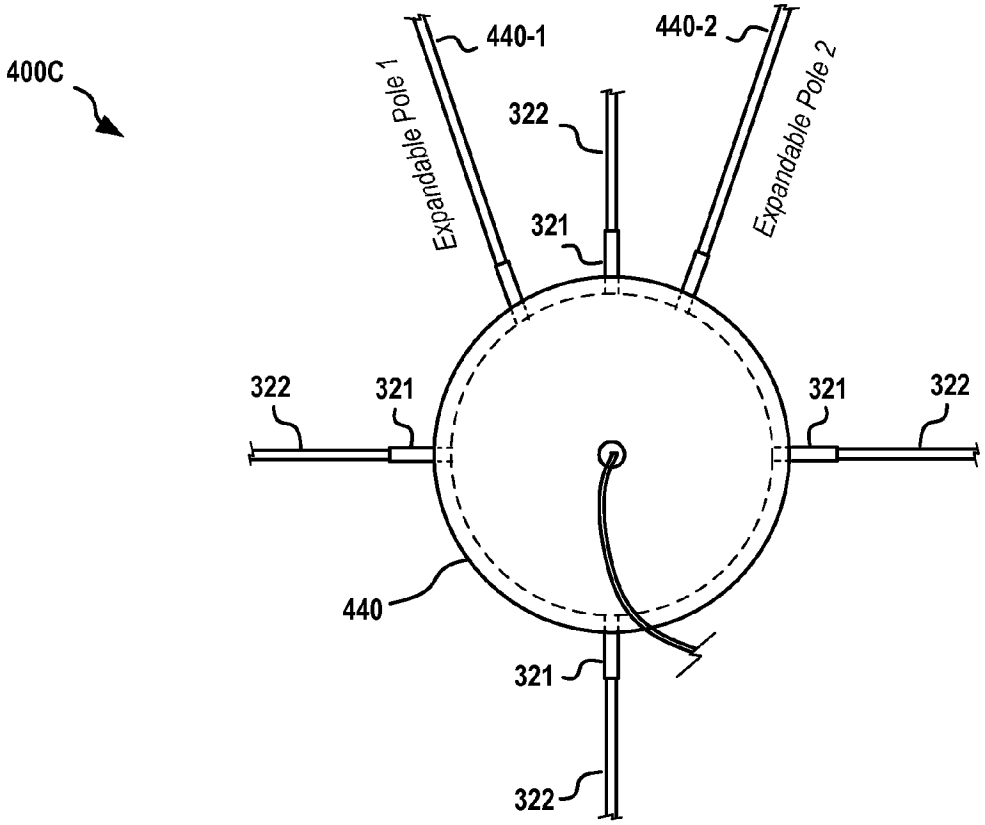

FIG. 4A illustrates details of a tent frame and pole structure 300 including a novel hub embodiment 410 including an additional coupling element 441 attached to the hub 410 for providing support for an expansion frame 440 including one or more expansion pole segments. The expandable pole section may include a coupling assembly configured similarly to coupling elements 321 as shown in FIG. 4, but may exclude any connection to the lower part of the hub (e.g., by not including an angle support 330 as shown on the expandable pole section). In this way the expandable pole section can be positioned in an upward orientation relative to the hub to allow a volume of the tent or other structure to be higher than the hub. In various configurations, a hub such as hub embodiment 410 may be coupled to one or more expansion pole segments, such as in the configurations shown in FIGS. 4B and 4C. For example, in FIG. 4B, a hub embodiment 400B, as shown in a top view, may include a single expandable pole section 440, coupled to the hub only at a top hub element, at coupling connection 441. FIG. 4C illustrates an alternate hub embodiment 400C, which includes two expandable pole sections 440-1 and 440-2. A hub such as hub 400C may be used in a tent such as shown in FIG. 6F to allow a volume of the tent to be positioned higher than the top of the hub, thereby increasing interior tent volume while still allowing access to the hub for erection and disassembly.

Figure 5:
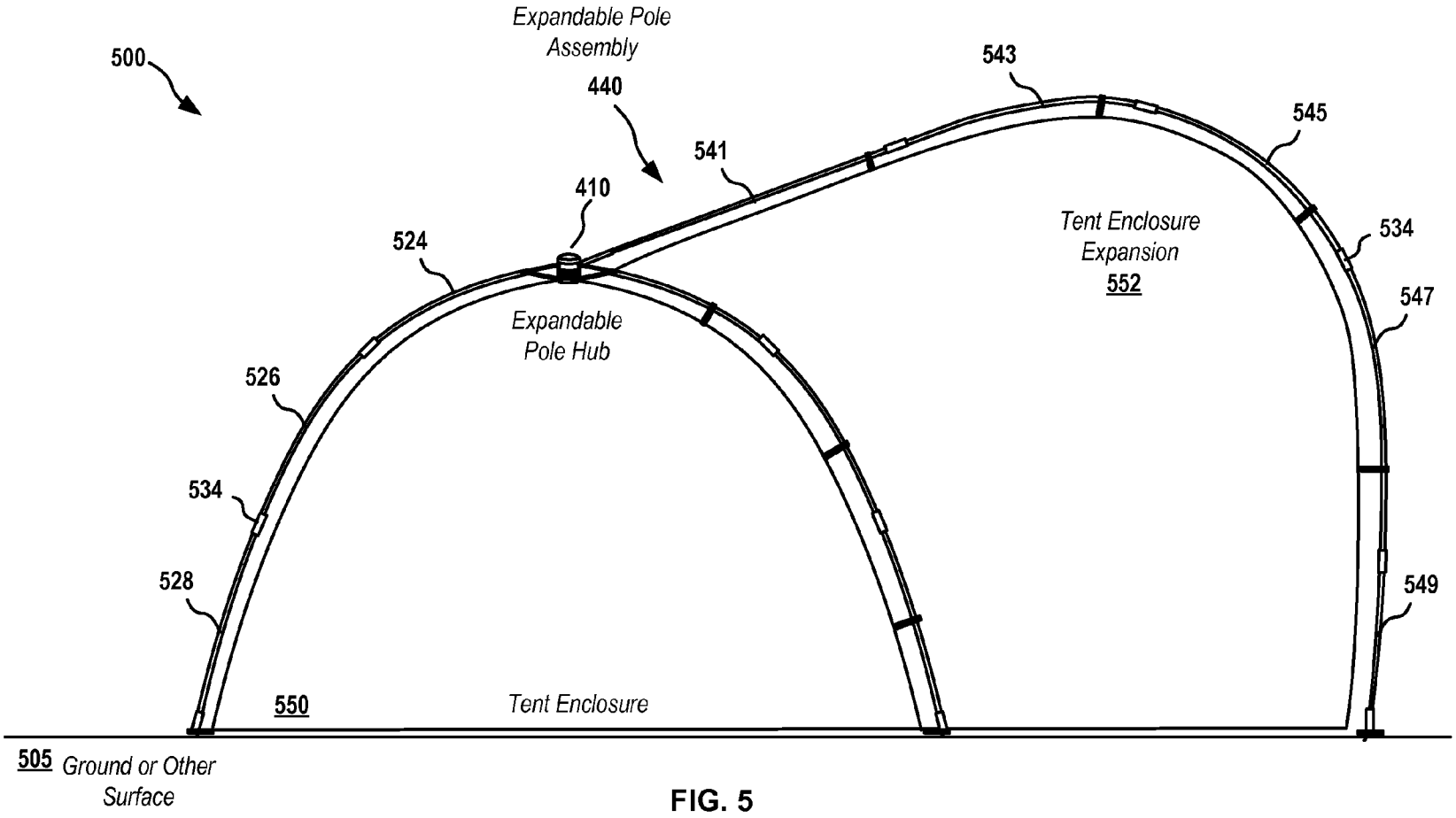
FIG. 5 illustrates details of an embodiment of a tent including an expandable frame structure and hub such as shown in FIG. 4.

FIG. 5 illustrates an example tent embodiment 500 using a hub such as hub embodiment 400 of FIG. 4 to support an expandable pole assembly 440 to support a tent enclosure expansion 552, which may be fabric or other materials. As shown in FIG. 5, tent 500 may include a front frame structure similar to that of tent embodiment 100, with the front frame structure including one or more poles, such as poles 528, 526, and 524, coupled by joints 534, and further attached to hub 410. The expansion frame may include a plurality of poles, such as poles 541, 543, 545, 547, and 549 (or other numbers and/or shapes and sizes of poles) coupled by joints 534.

Figure 6A:
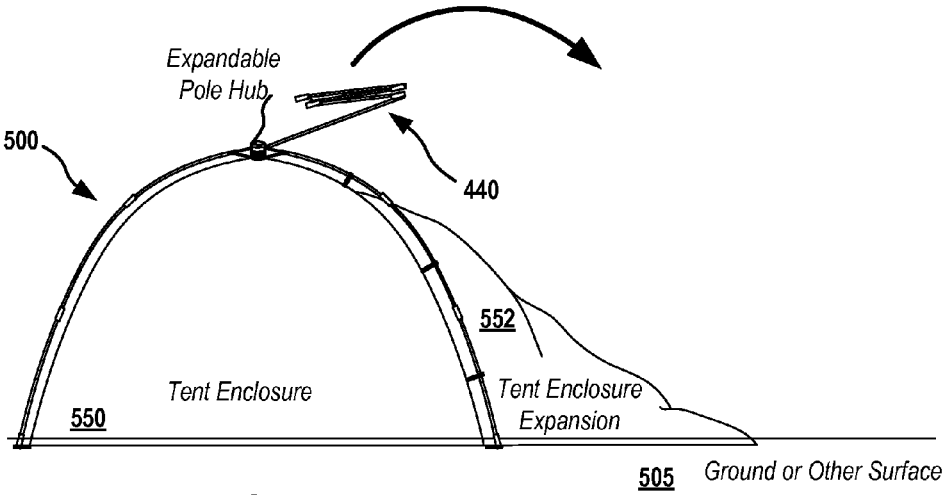
FIGS. 6A-6E illustrate an example sequential erection of a tent having an expandable frame structure and hub such as shown in FIG. 4.
Figure 6B:
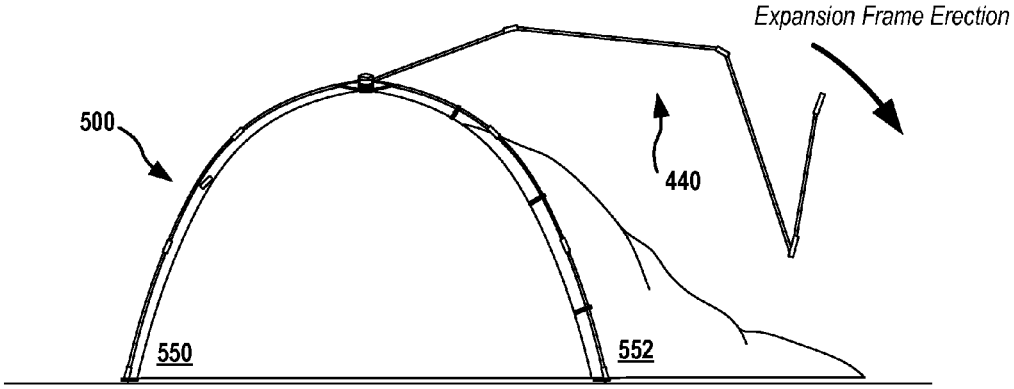
Figure 6C:
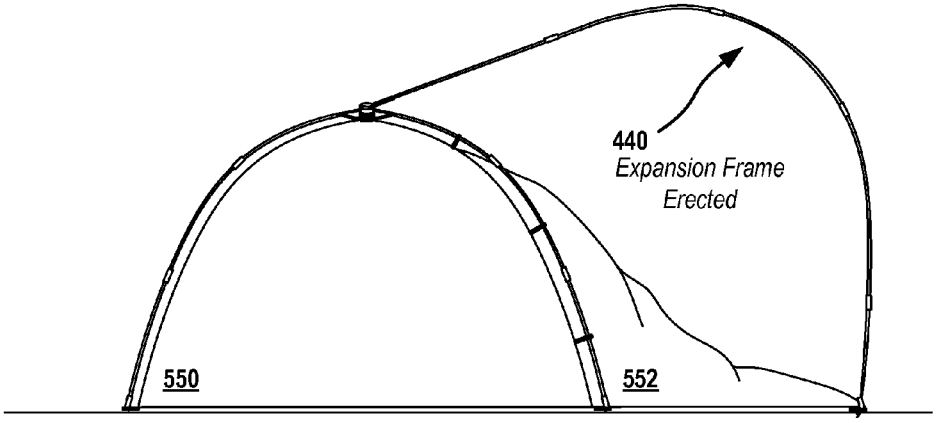
Figure 6D:
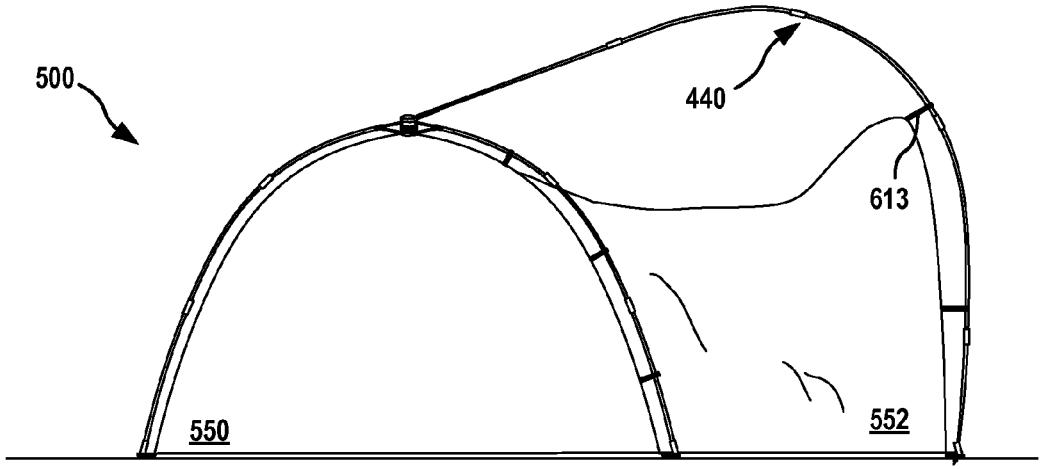
Figure 6E:
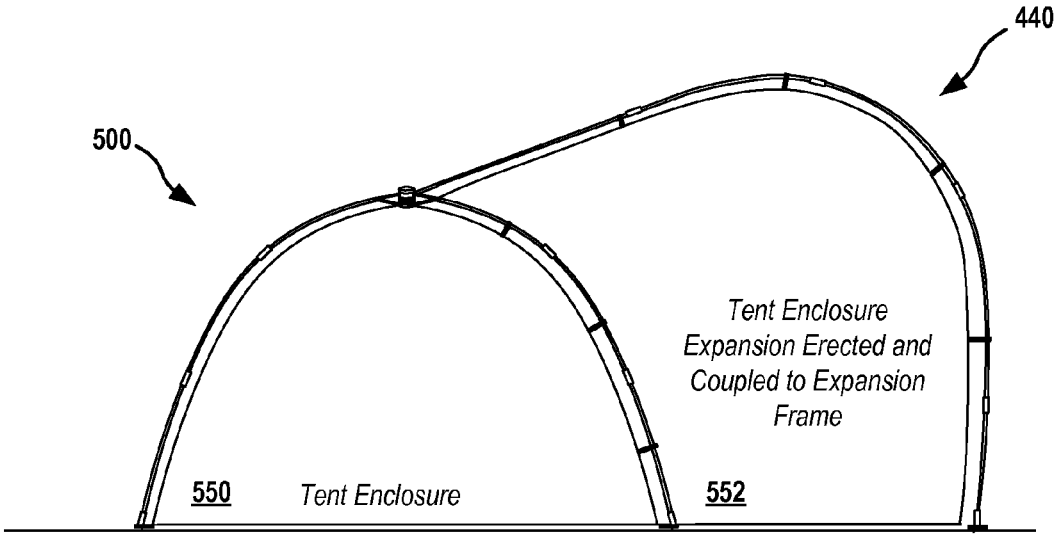

FIGS. 6A-6E illustrate an example erection process for a tent having an expandable pole assembly and hub such as hub 410 of FIG. 4. As shown in FIG. 6A, the expandable pole assembly 440 may initially be folded or retracted at the start of assembly. FIG. 6B illustrated outward unfolding of the pole elements and joints of pole assembly 440 to form the expansion frame. FIG. 6C illustrates the expansion frame fully deployed, with the tent fabric still unattached. FIG. 6D illustrates attachment of the tent fabric to the expansion frame, with straps 613 or other attachment mechanisms of the tent frame. FIG. 6E illustrates tent 500 fully erected.

Figure 6F:
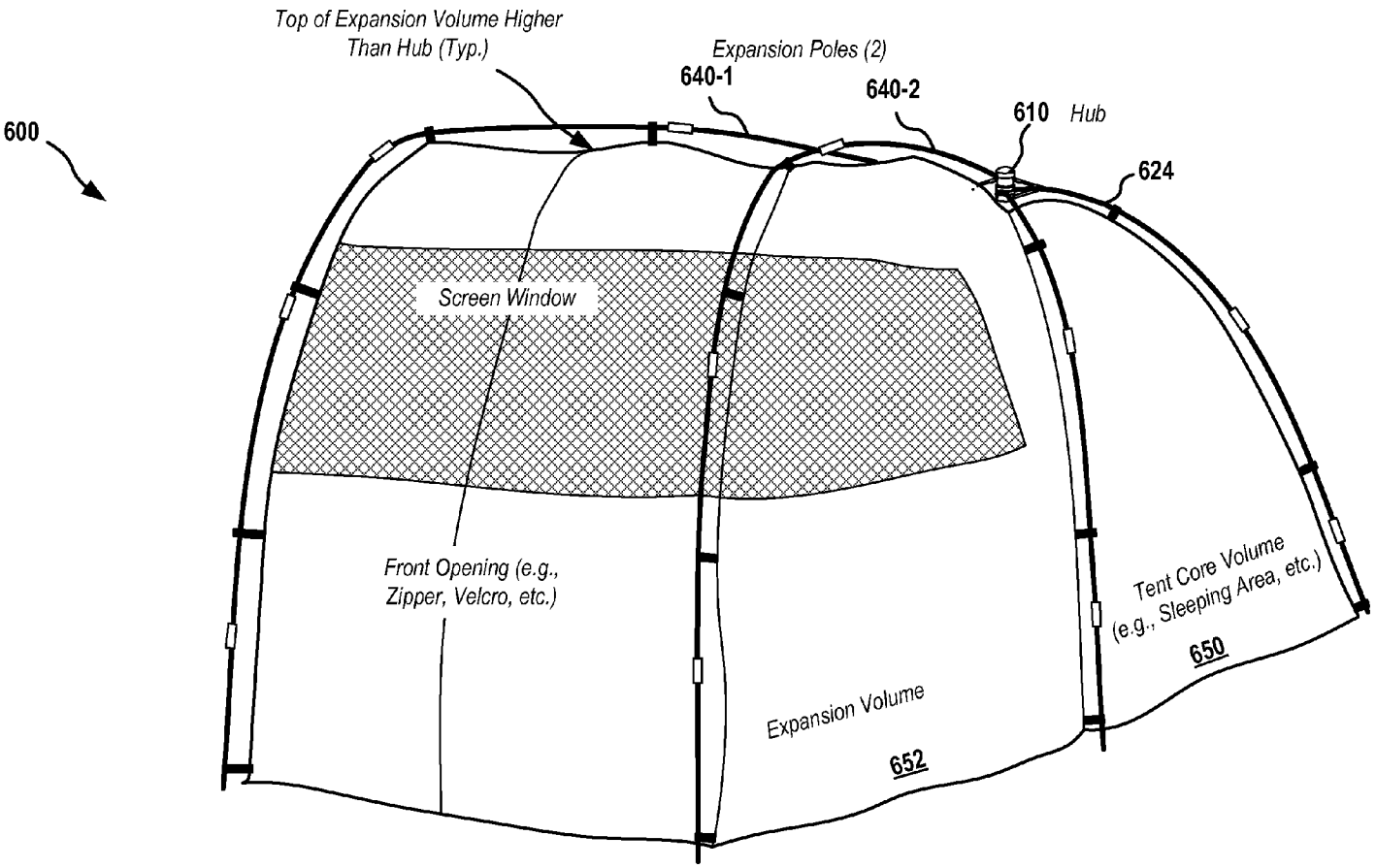
FIG. 6F illustrates details of one embodiment of a tent using an expandable pole and corresponding hub, in the form of a hunting blind.

FIG. 6F illustrates details of an embodiment of a tent 600 having a pair of expandable poles 640-1 and 640-2 to support an expansion volume 652 from hub 610. Hub 610 may be centered over a tent core volume 650 as shown, which may be positioned lower, relative to the ground or other surface on which the tent is mounted, than the expansion volume 652. In this configuration, the expansion poles 640-1 and 640-2 allow the expansion area to be taller than the height of the hub 610. For example, in an application such as a hunting blind, the expansion volume may be used for watching for animals, and may have a screen and/or front opening, while the tent core volume, which may be lower in height, may be used for sleeping, resting, eating, etc.

Figure 7A:
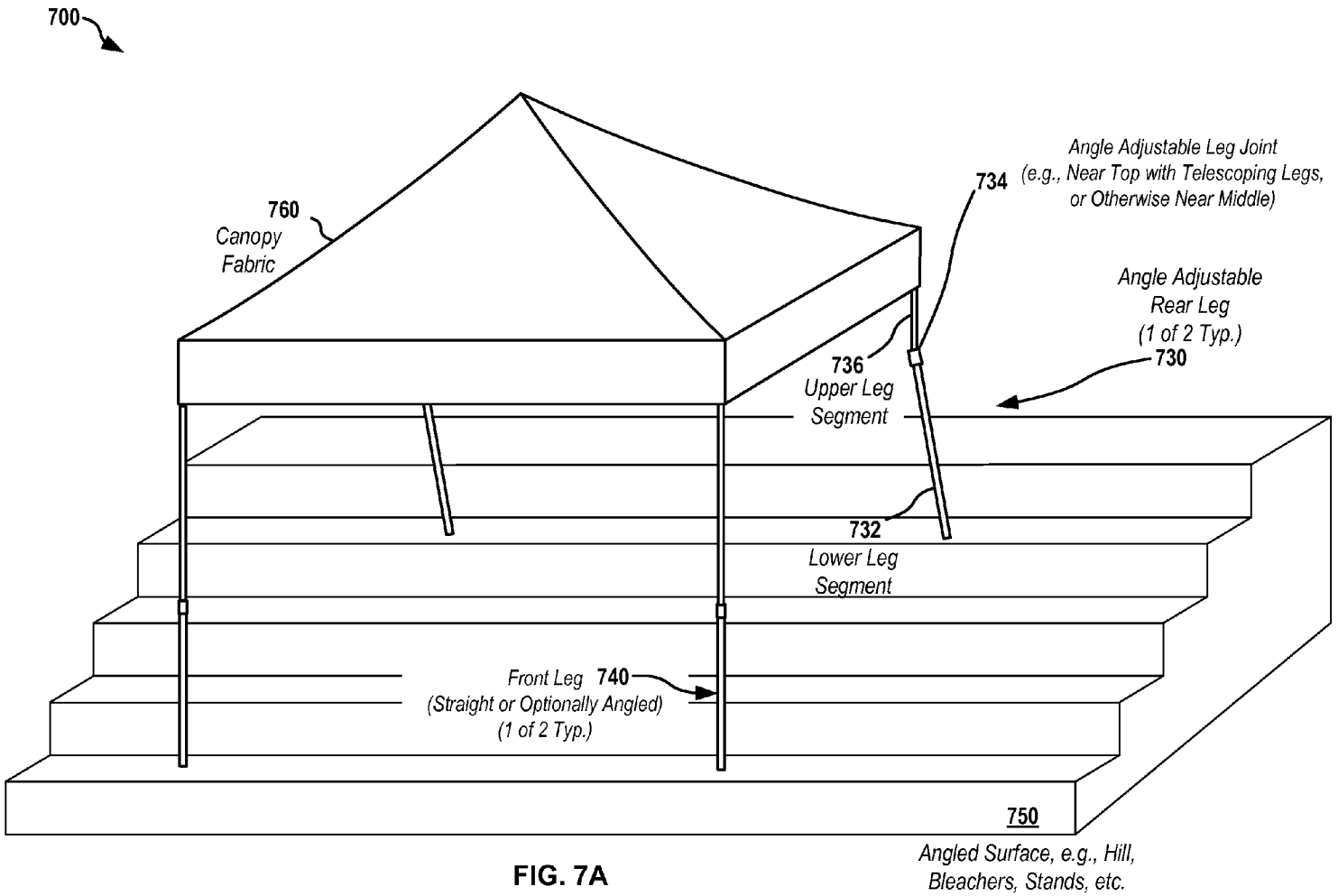
FIG. 7A-7E illustrate details of embodiments of a canopy having angled jointed legs for use on an angled surface such as a hill or bench.
Figure 7C:
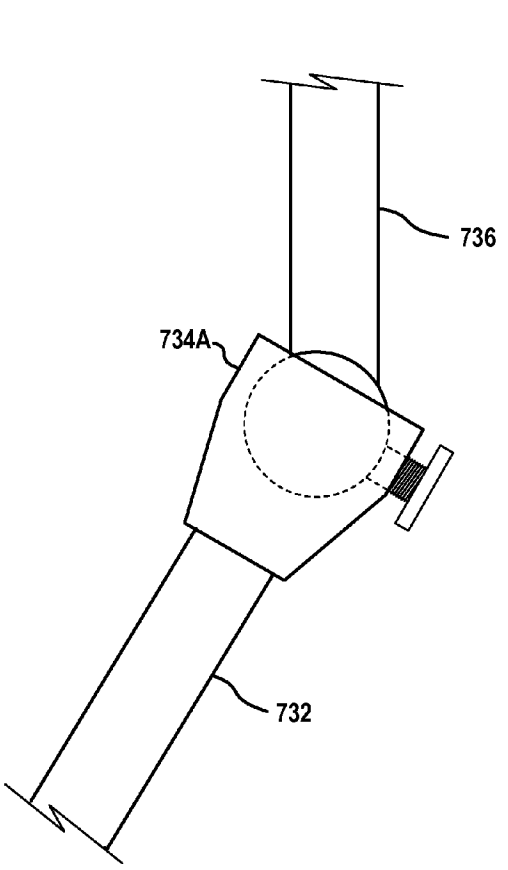
Figure 7B:
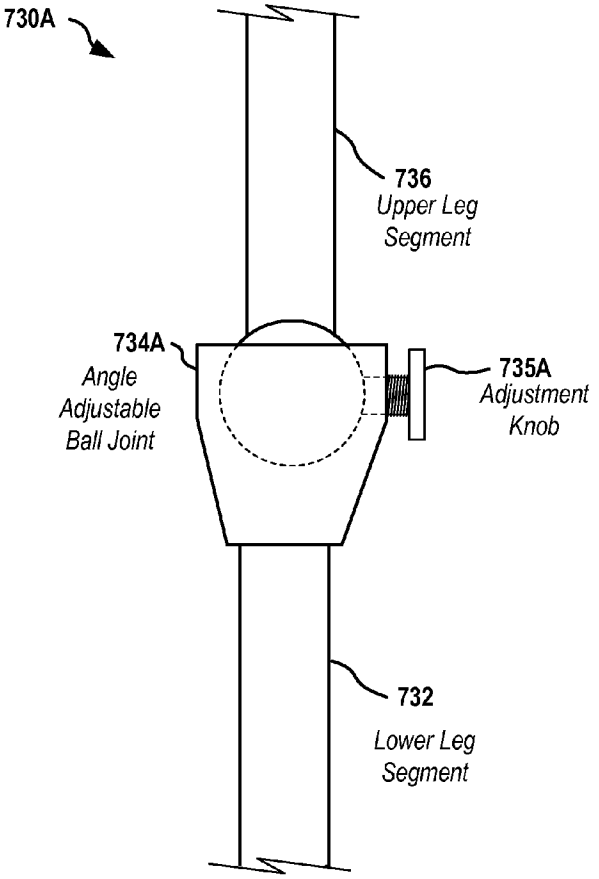
Figure 7F:
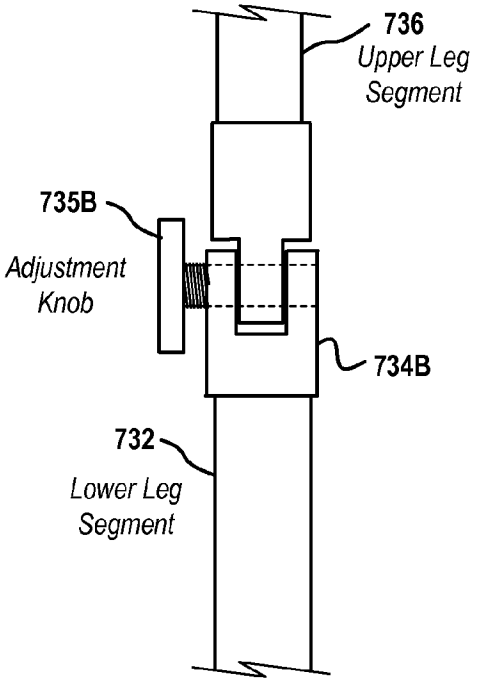

Expandable poles as described herein may be used for a variety of other applications in addition to those shown in FIG. 7F and may have one or more expansion poles extending upward and/or outward from one or more hubs.

FIG. 7A illustrates details of another aspect of the disclosure showing an embodiment of a canopy 700 with one or more angle adjustable legs 730. The legs of canopy 700 may be telescoping and may be coupled to a frame structure, which may be covered partially or fully by the canopy fabric to expand to support the canopy upon erection and fold to facilitate storage of the canopy. The frame may be a scissors-type expanding frame or other canopy frame types known or developed in the art. In the canopy embodiment shown in FIG. 7A, the canopy frame structure is not shown (e.g., is hidden behind the canopy fabric).

A canopy tent such as tent embodiment 700 may be advantageously used on a sloped or other non-level surface, such as on a stand 750 or bleachers, hill, or other angled surface. Canopy embodiment 700 may be configured similarly to canopy 200 of FIG. 2 with a canopy top 760 or fabric or plastic, along with the addition of two or more angle adjustable legs 730. In some embodiments, two of four legs are angle adjustable, with other legs being straight as shown in FIG. 7A as front legs 740. However, in alternate embodiments all of the legs may be angle adjustable.

Figure 8:
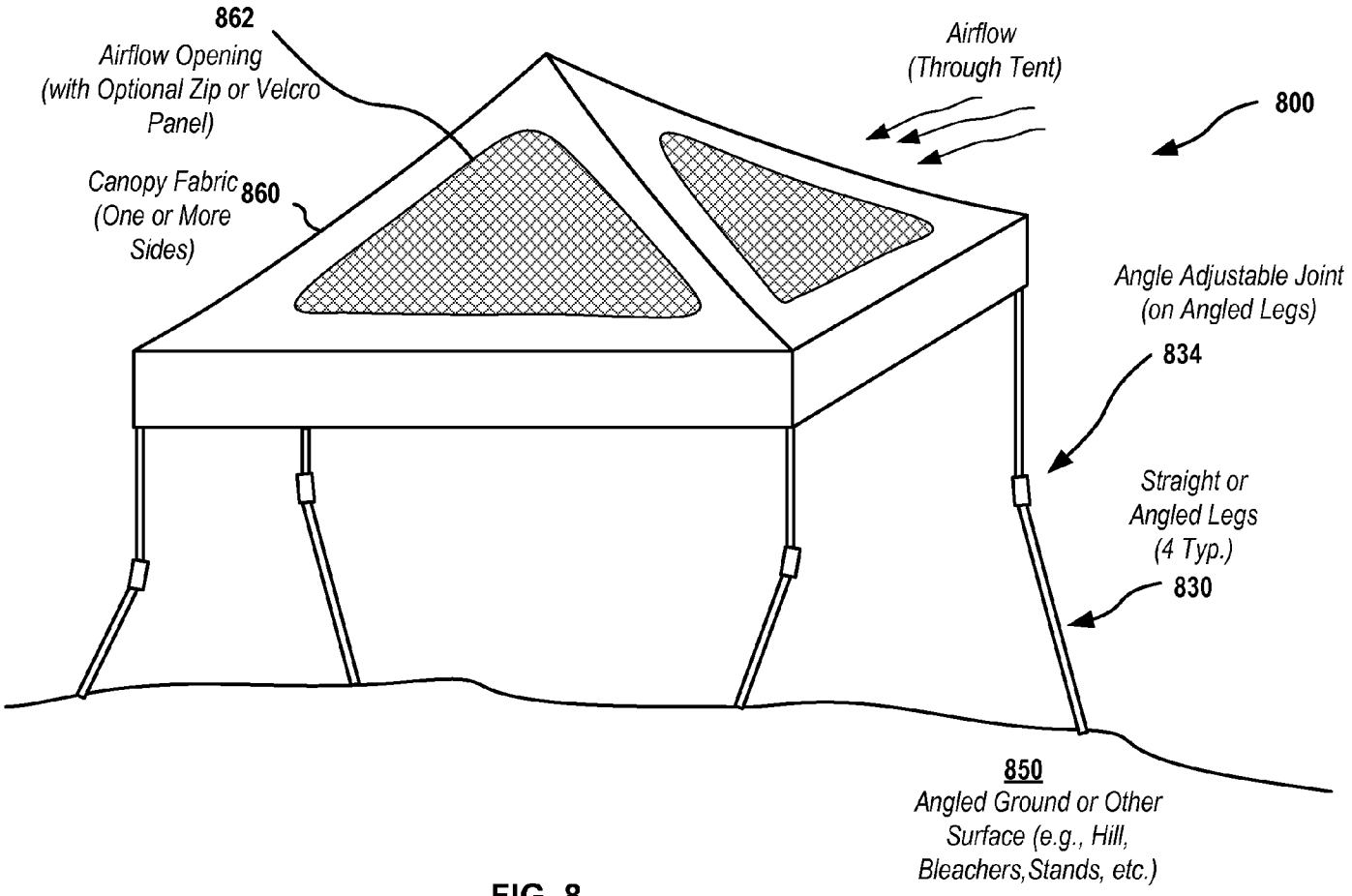
FIG. 8 illustrates details of an embodiment of a canopy having an airflow opening for use on an angled surface such as a hill or bench.

Legs 740 may include two or more leg segments, such as a lower leg segment 732 and an upper leg segment 736, which may be coupled with an angle adjustable leg joint 734, which allows the lower segment 732 to be at an offset angle from the upper leg segment 736. Various other configurations may be used in alternate embodiments to allow one or more legs (typically two or four) to be offset at an angle from vertical to provide additional support when the canopy is erected on an angled surface. In some canopy or gazebo embodiments, angle adjustable legs may be combined with a vented canopy top, such as shown in FIG. 8 and described subsequently herein.

FIGS. 7B and 7C illustrate details of an embodiment of an angle adjustable joint 743A as may be used in an angle adjustable leg 730A. Leg 730A may correspond with leg 730 of FIG. 7A. In this angle adjustable joint embodiment, a ball joint configuration may be used to allow the lower leg segment 732 to be adjusted at an angle offset from that of upper leg segment 736. The angle adjustment may be done in one dimensional axis or in some embodiments in two orthogonal dimensions. An adjustment know 735A, which may be a screw knob, clamp, hinged bracket, snap, or other lockable mechanism may be used to lock the ball joint into a particular position for erection, and then release the ball for disassembly and storage. In some ball joint configurations, the ball and socket elements may be configured with slots or other mechanisms to allow the lower leg to fold back onto the upper leg for storage. Alternately embodiments may use additional hinges, brackets, or other mechanisms (not shown) to allow the lower leg to fold up relative to the upper leg, typically to approximately 180 degrees from the erected position, for storage or transportation.

FIG. 7C illustrates a side view of the angle adjustable ball joint 734A in an offset angle position. This configuration may be used in canopy, tent, or gazebo structures placed on an angled surface, such as shown in FIG. 7A or FIG. 8, to provide better support. Canopies, tents, or gazebos with angled legs may also be used in environments where there are winds so as to reduce the likelihood of the structure from blowing over. Angled legs may be combined in various embodiments with other aspects, such as airflow canopy tops, angled feet, stakes, or other securing mechanisms to provide enhanced support.

In some embodiments, the angled joint of the angle adjustable legs may be positioned approximately in the middle of the legs. This configuration may be advantageous where non-telescoping legs are used. Alternately, the angle adjustable joints may be positioned approximately at the top of the legs. This configuration may be advantageous with telescoping legs, so as to allow the lower leg segment to telescope downward to an adjustable length (in combination with the adjustable angle).

In an exemplary embodiment, the adjustable angle joint may be configured similarly to a ball and socket type tripod joint to allow adjustment of the offset angle in two directions. Alternately embodiments may use other angle adjustable mechanisms such as hinges or brackets, or other mechanisms known or developed in the art to allow one leg segment to be fixed at an offset angle from another leg segment. Likewise, other mechanisms may be used to secure the angle adjustable joint in a locked position and allow quick release. For example, while a threaded knob may be used for tightening and loosening the joint, such as adjustment know 735A as shown in FIGS. 7B and 7C, clamps, hinges, brackets, or other securing mechanisms may be used to allow quick adjustment, locking, and release of the angle adjustable joint during erection and disassembly. In some embodiments, an angle adjustable joint may be combined with a telescoping mechanism to provide angle and length adjustable legs on tents, canopies, gazebos, or other structures.

Figure 7E:
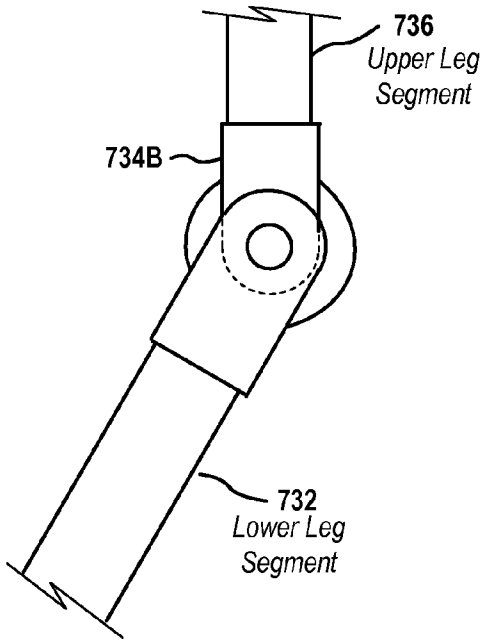
Figure 7D:
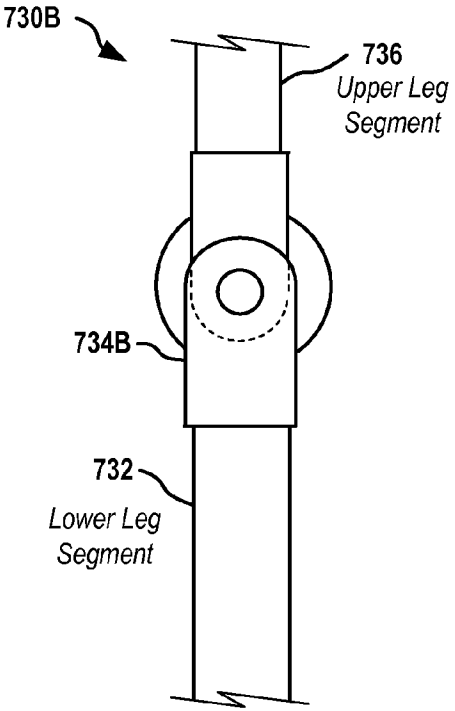

FIGS. 7D and 7E illustrate details of an alternate embodiment 7304B of an angle adjustable joint on an angle adjustable leg 730B. In this configuration, pair of interlocking joint elements are coupled using friction with an adjustment knob 735B. Tightening adjustment knob 735B secures the two joint sections together by friction, and releasing knob 735B allow the lower and upper leg segments to rotate in one dimension relative to each other. In alternate embodiments, various other angle adjustable coupling mechanisms may be used to join the lower and upper leg sections 732 and 736 in an angle offset position relative to each other.

FIG. 8 illustrates details of another aspect of the disclosure showing a canopy tent embodiment 800, which may be configured with straight legs as shown in canopy embodiment 200 or with one or more angled legs as shown in canopy embodiment 700, along with a canopy top 860 including one or more airflow openings to allow air to flow through the canopy to reduce the risk of the canopy blowing over when subjected to winds or other airflow. In an exemplary embodiment, two angled legs may be included on a side of the canopy that will face uphill when installed, however, other leg configurations, such as canopy configurations having four or more angle-adjustable legs, may be used in alternate embodiments.

Figure 14:
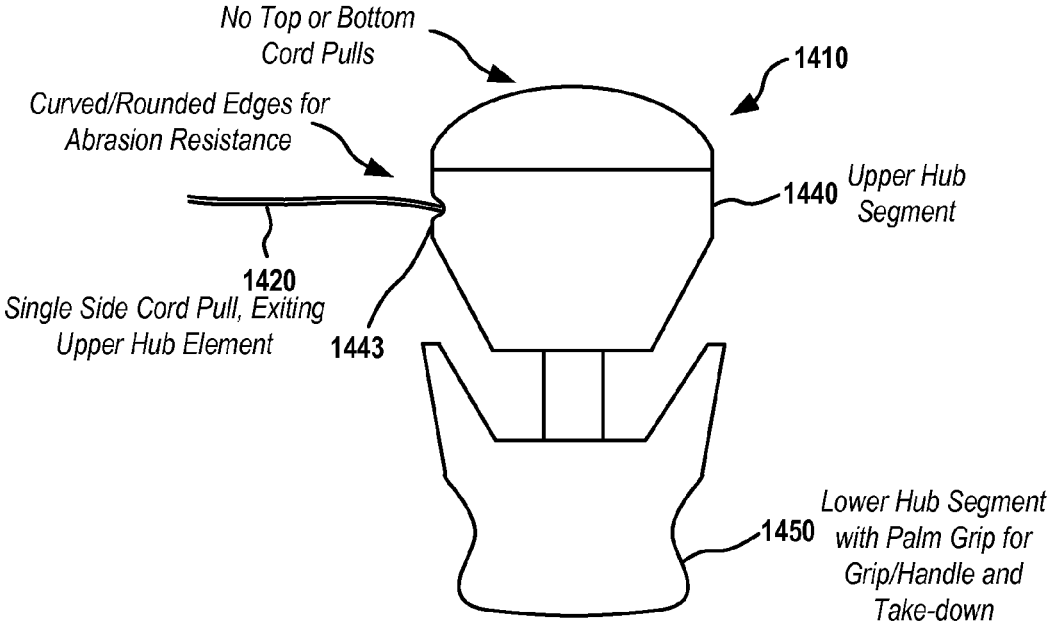
FIG. 14 illustrates details of an alternate embodiment of a side-pull hub in accordance with certain aspects.

Canopy embodiment 800 may be advantageously configured with angled legs 830, which may be the same as or similar to the angled legs 730 of FIG. 7, or may, in some embodiments, use only straight legs. When used in combination with height adjustable angled legs on a non-level surface 850, the canopy 800 may be erected so that the airflow opening 862 allows air to pass through the canopy top rather than catching the top like a sail, thereby reducing the risk of the canopy blowing over and be damaged or causing property damage or personal injury. In various embodiments, one or more airflow openings 862 may be included in the canopy top area. For example, for cost reasons, a single airflow opening may be used in a lower cost canopy, however, to achieve maximum resistance to applied wind forces, openings may be included in two or more sides of the canopy in alternate embodiments. The canopy openings and/or angle-adjustable legs may also be combined in some embodiments with angle-adjustable feet or base plates as shown in FIG. 14 and described subsequently herein.

Figure 9:
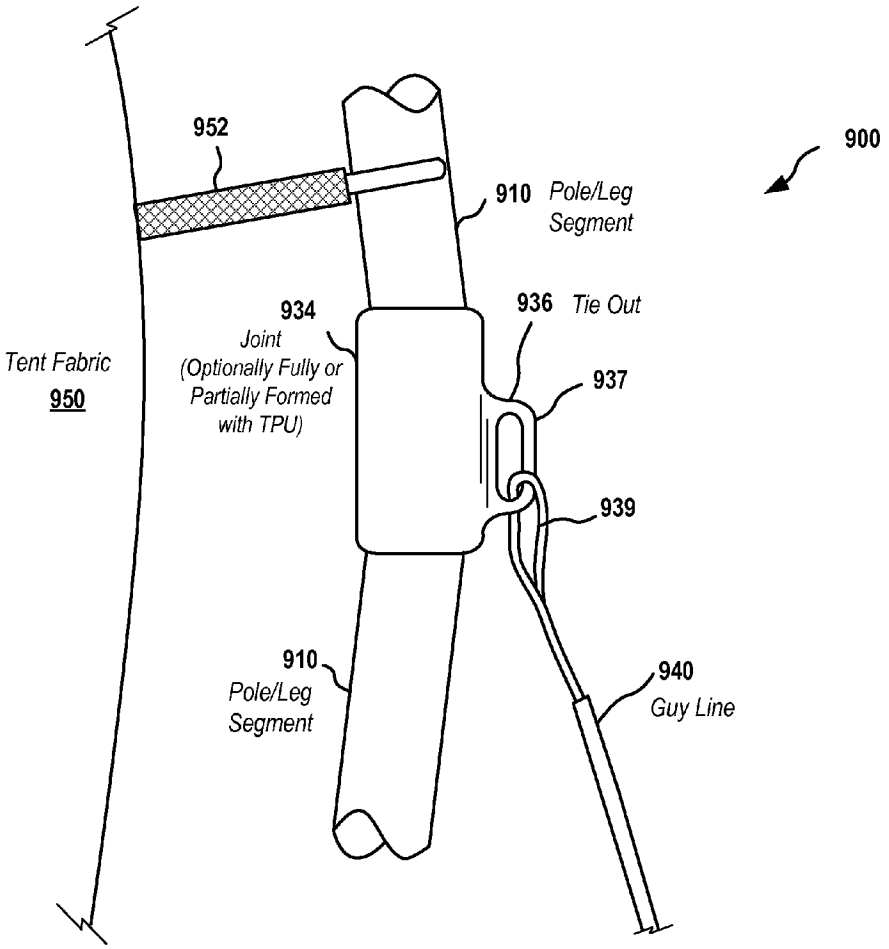
FIG. 9 illustrates details of an embodiment of a joint for use on a tent or canopy having an integral guy-line tie out.

FIG. 9 illustrates details of another aspect of the disclosure showing a joint embodiment 934, which may be used on various tents, canopies, or gazebos, such as tent 100 of FIG. 1, or tent 500 of FIG. 5. An improved attachment point between the tent structure and the ground or other attachment surface may be provided by using a joint with an integral tie-out, such as joint embodiment 934 having integral tie-out 936 for providing an attachment point between the tent frame and the ground or other surface or attachment point. As shown in FIG. 9, a guy line 940 may be attached to the joint 932 at a tie-out 936, which may include a corresponding loop 937 or other opening or clip mechanism. Guy line 940, which may include a loop 939, clip, carabiner, or other attachment mechanism, may be secured to the tie out 936 at the loop 937 to secure it to the joint 934. Tie out loop 937 may be configured as a simple circular, oval, or other rounded or eye-shaped opening, or, in alternate embodiments, may include other attachment mechanisms such as a clip or snap-on connector (not shown). Frame pole segments 910 may attach to the joint 934 as shown to form the frame or legs of the tent, canopy, or other structure. The frame pole segments 910 may be attached to the tent fabric with straps 952 and snap-on clips, or other attachment elements.

Figure 10:
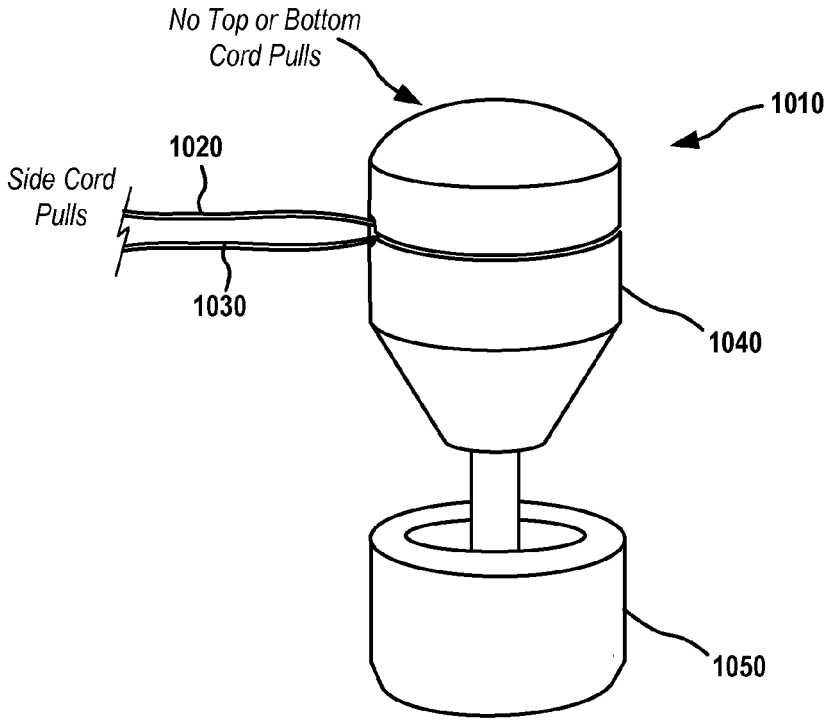
FIG. 10 illustrates details of an embodiment of a side-pull hub in accordance with certain aspects.

FIG. 10 illustrates details of another aspect of the disclosure showing a side-pull hub embodiment 1010. As noted previously herein, prior art hubs for use on tents such as tent 100 or tent 500 have used top pull or bottom pull hubs, wherein the tent is erected by pulling a cord from the top of the hub or bottom of the hub, with internal gearing or other mechanisms expanding the frame during the pulling action. While these configurations allow rapid tent erection, an alternate configuration, using one or two cords pulled from the side, rather than the top or bottom, may be used instead and may provide better user action and leverage for tent erection, as well as providing other advantages such as elimination of cord coming out of the top or bottom of the hub, providing better grip action, or providing other advantages.

Figure 11:
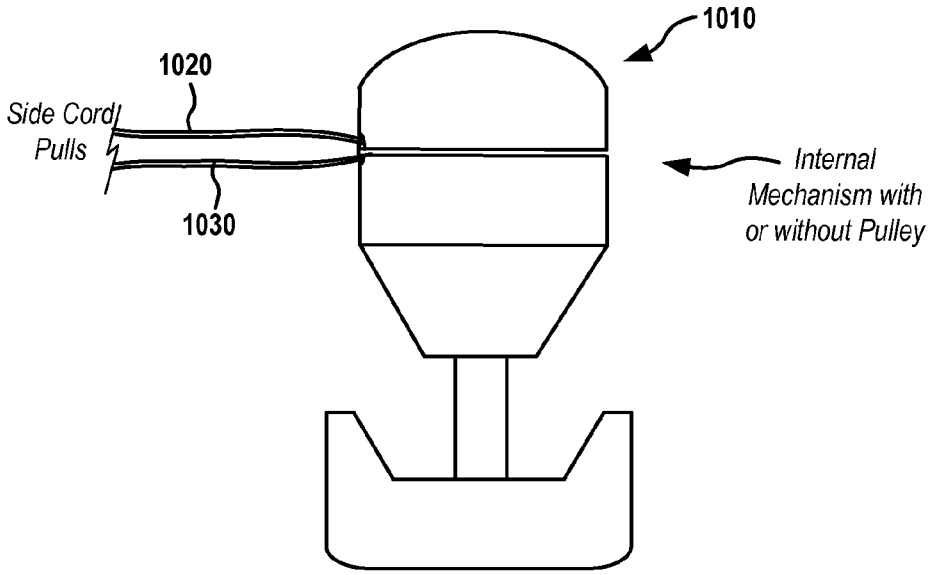
FIG. 11 illustrates a cutaway view of the side-pull hub embodiment of FIG. 10.

As shown in FIG. 10, side-pull hub embodiment 1010 includes a pair of pull cords 1020 and 1030 exiting the side of an upper hub element 1040. A lower hub element 1050 may be configured to allow a firm user grip on the hub during tent erection and disassembly. FIG. 11 illustrates a cutaway view of side-pull hub embodiment 1010. In some embodiments, the internal mechanism of hub 1010, which may be within upper hub element 1040, may include a pulley, gearing, or other elements to provide mechanical advantage during erection of the tent. Alternately, in some embodiments no mechanical advantage may be used.

Figure 12:
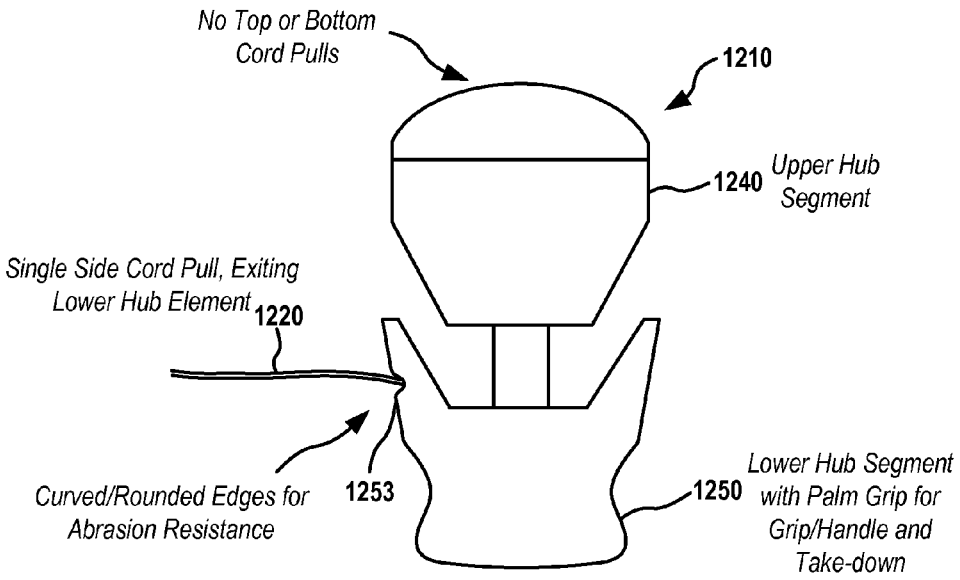
FIG. 12 illustrates details of an alternate embodiment of a side-pull hub in accordance with certain aspects.

FIG. 12 illustrates a cutaway view of an alternate side-pull hub embodiment 1210. In this side-pull hub embodiment, a single pull cord 1220 may be used, rather than two cords. The single pull cord may be coupled to mechanical apparatus similar to that shown in FIG. 16 (or other internal mechanisms as are known or developed in the art) disposed within the hub elements 1240 and 1250, which may be configured with an ergonomic palm grip or handle shape to aid in erection or disassembly/take down of the tent. An opening 1253 may be formed in a side of the lower hub element 1250 to allow the cord 1220 to be pulled from (or drawn into) the hub. Edges of the opening 1253 may be rounded and smoothed to reduce abrasion to the cord 1220 during actuation and to provide smooth pulling action. Upper hub element 1240 may be configured with a rounded shape to aid in gripping the hub during erection (e.g., when pulling cord 1220 outward from the lower hub element 1250).

Figure 13:
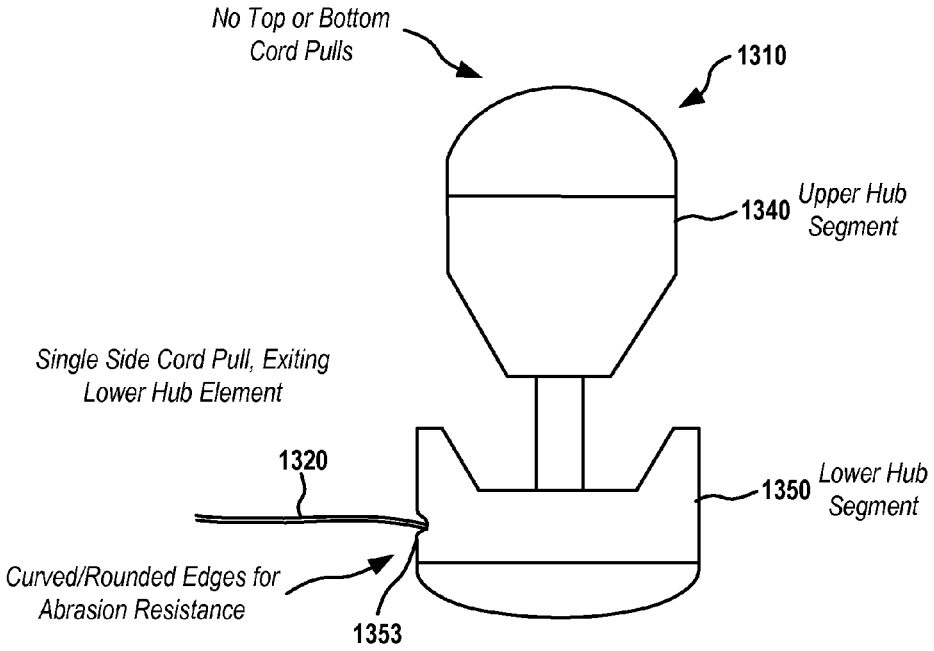
FIG. 13 illustrates details of an alternate embodiment of a side-pull hub in accordance with certain aspects.

FIG. 13 illustrates a cutaway view of another alternate side-pull hub embodiment 1310. In this side-pull hub embodiment, a single pull cord 1320 may be used, rather than two cords. The single pull cord may be coupled to mechanical apparatus similar to that shown in FIG. 16 (or other internal mechanisms as are known or developed in the art) disposed within the upper and lower hub elements 1340 and 1350, which may be configured with an ergonomic palm grip or handle shape to aid in erection or disassembly/take down of the tent. An opening 1353 may be formed in a side of the lower hub element 1350 to allow the cord 1320 to be pulled from (or drawn into) the hub. Edges of the opening 1353 may be rounded and smoothed to reduce abrasion to the cord 1320 during actuation and to provide smooth pulling action. Upper hub element 1340 may be configured with a rounded shape to aid in gripping the hub during erection (e.g., when pulling cord 1320 outward from the lower hub element 1350).

FIG. 14 illustrates a cutaway view of yet another alternate side-pull hub embodiment 1410. In this side-pull hub embodiment, a single pull cord 1420 may be used, rather than two cords. The single pull cord may be coupled to mechanical apparatus similar to that shown in FIG. 16 (or other internal mechanisms as are known or developed in the art) disposed within the lower and upper hub elements 1440 and 1450, while the lower hub element 1450 may be configured with an ergonomic palm grip or handle shape to aid in erection or disassembly/take down of the tent. An opening 1443 may be formed in a side of the upper hub element 1440 to allow the cord 1420 to be pulled from (or drawn into) the hub. Edges of the opening 1443 may be rounded and smoothed to reduce abrasion to the cord 1420 during actuation and to provide smooth pulling action. Upper hub element 1440 may be configured with a rounded shape to aid in gripping the hub during erection (e.g., when pulling cord 1420 outward from the upper hub element 1440).

Figure 15:
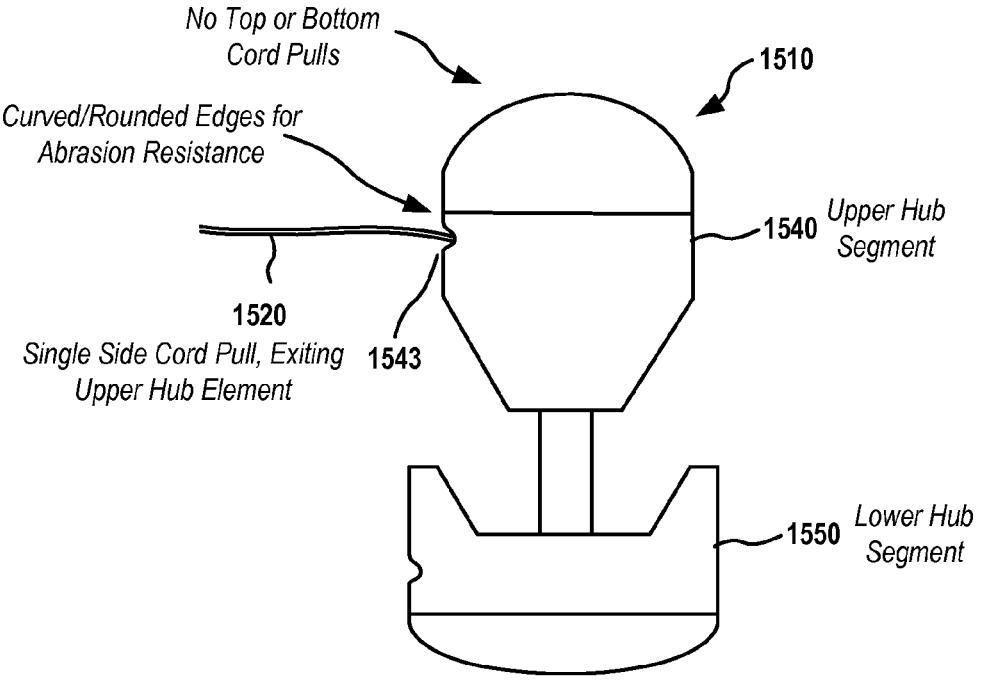
FIG. 15 illustrates details of an alternate embodiment of a side-pull hub in accordance with certain aspects.

FIG. 15 illustrates a cutaway view of yet another alternate side-pull hub embodiment 1510. In this side-pull hub embodiment, a single pull cord 1520 may be used, rather than two cords. The single pull cord may be coupled to mechanical apparatus similar to that shown in FIG. 16 (or other internal mechanisms as are known or developed in the art) disposed within the lower and upper hub elements 1540 and 1550. The lower hub element 1550 may be configured with an ergonomic palm grip or handle shape to aid in erection or disassembly/take down of the tent. An opening 1543 may be formed in a side of the lower hub element 1540 to allow the cord 1520 to be pulled from (or drawn into) the hub. Edges of the opening 1543 may be rounded and smoothed to reduce abrasion to the cord 1520 during actuation and to provide smooth pulling action. Upper hub element 1540 may be configured with a rounded shape to aid in gripping the hub during erection (e.g., when pulling cord 1520 outward from the upper hub element 1550).

Figure 16:
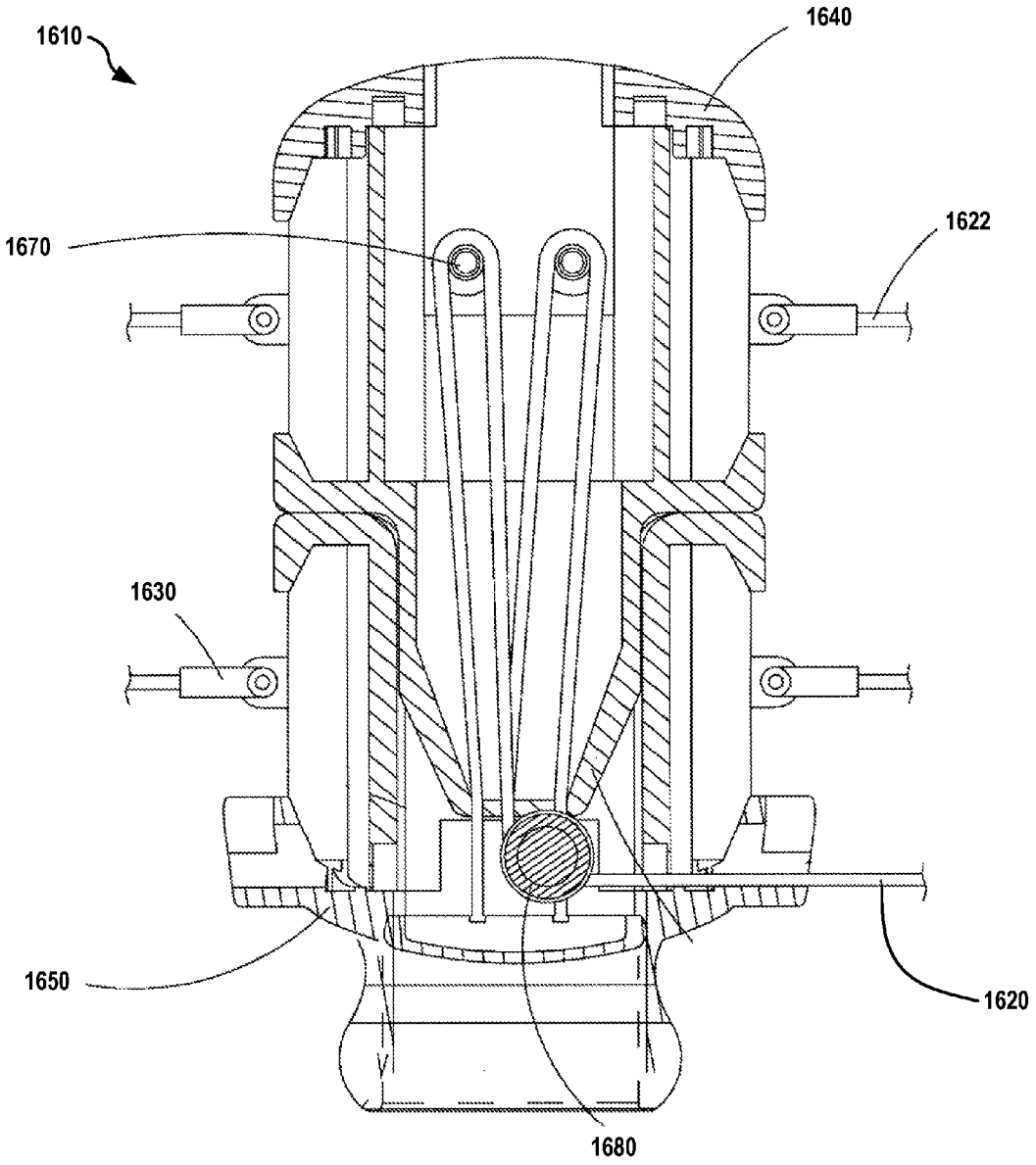
FIG. 16 illustrates details of an embodiment of a side-pull hub internal mechanism in accordance with certain aspects.

FIG. 16 illustrates details of one embodiment of a side-pull hub 1610 internal mechanism as may be used in a hub such as those shown in FIGS. 12 and 13 where the pull cable exits from the bottom hub element. A similar configuration may be used in side pull hubs having an upper hub element side exit, such as shown in FIGS. 14 and 15, with the internal components configured to allow exit of the pull cable through the side of the top hub element rather than the side of the bottom hub element. Hub embodiment 1610 includes an upper hub element 1640 and a lower hub element 1650. A pull cable, such as pull cable 1620 as shown, may include a proximal end attached to the hub (e.g., to the lower hub element 1650 as shown in FIG. 16 or alternately to the upper hub element). A distal end of the pull cord may be passed through an opening in the hub, such as in the lower hub element as shown in FIG. 16 (or alternately through an upper hub element as shown in FIGS. 14 and 15) to allow a user to pull on the pull cable to raise the tent.

Pull cable 1620 may be configured to exit through a side of the lower hub element 1650 via a rounded edge (as shown in FIGS. 12 and 13) and may be attached through the lower hub element 1650 and positioned around one or more internal pulleys and/or gears (not shown) or other similar elements, such as pulleys 1670 and 1680. The pulleys and/or gears may be configured to provide mechanical advantage in some embodiments, such as by reducing the required pulling force proportionally to the number of pulleys and/or as a function of selected gear ratios, etc. A plurality of upper and lower pole segments may extend outward from the hub upper element 1640 and hub lower element 1650, such as upper pole segment 1622 and lower pole segment 1630 as shown. Poles and hub attachment mechanisms may be configured as shown in FIGS. 3A-4C in various embodiments. Hub upper and lower elements may be configured similarly to the hub configurations shown in FIGS. 10-15 in various embodiments. Additional details of embodiments of aspects of hub and pull cable configurations as may be used in various embodiments are described and illustrated in PCT patent applications numbers PCT/CN/2012/072177 and PCT/CN/2012/074851. The content of each of these PCT patent applications is incorporated by reference herein its entirety.

Figure 17:
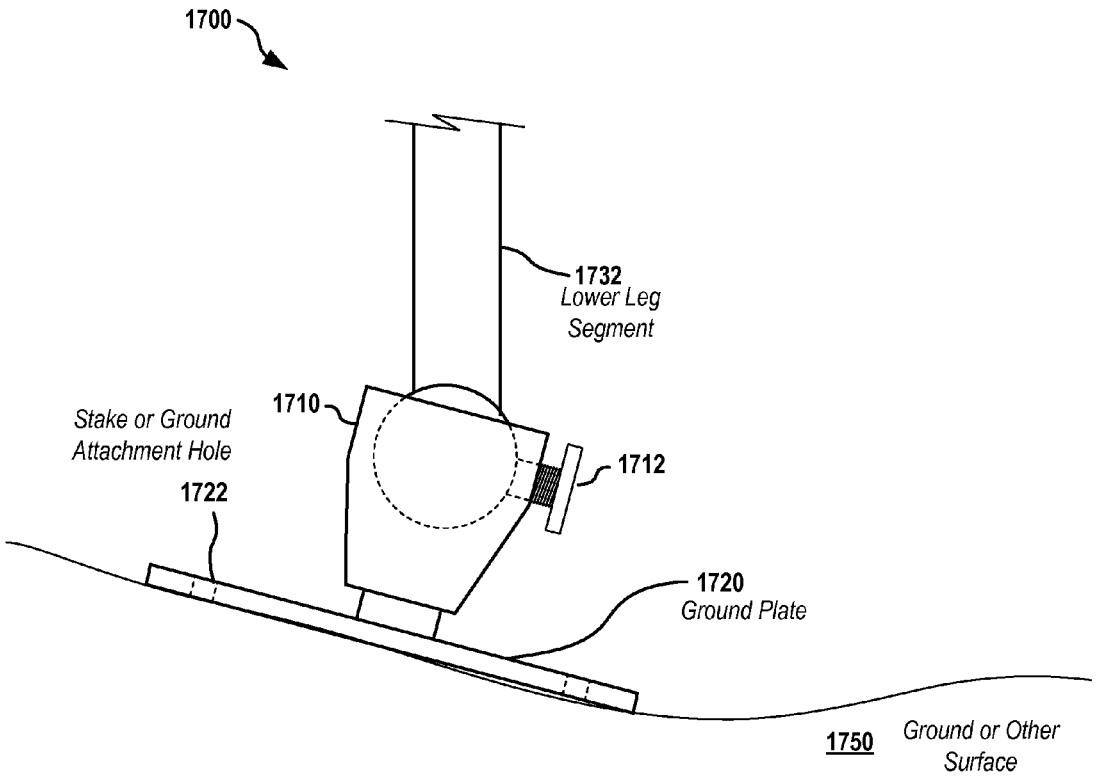
FIG. 17 illustrates details of an embodiment of an adjustable foot for use on portable tents, canopies, gazebos or similar structures.

FIG. 17 illustrates details of an embodiment of the lower portion of a leg assembly 1700 with an adjustable foot or base 1710 as may be used on a tent, canopy, gazebo or similar structure, such as the structures shown in FIG. 2, 5, 7A or 8. Adjustable foot 1710 may be configured with a ball joint as shown or with other movable elements, such as hinges or other movable, adjustable mechanical elements to allow a ground plate or support 1720 to rotate relative to the angle of a lower leg segment 1710 as shown. The adjustment mechanism may include a locking knob 1712 or other mechanical element to allow a user to lock the ground plate into an angled position. Alternately, the ground plate may be allowed to move relative to the lower leg segment 1732 to allow for compensation due to movement or applied forces.

This movable/adjustable base configuration may be used to provide a larger contact area between the ground plate 1720 and the ground or other surface 1750 on which the structure is erected so as to provide increased support over plates having a fixed angular orientation relative to coupled lower leg segments. Ground plate 1720 may further include holes 1722 or other attachment mechanisms to allow additional support and attachment to the ground, such as to resist forces such as winds on the canopy top or other applied forces.

The present invention is not intended to be limited to the aspects shown herein, but is to be accorded the full scope consistent with the specification and drawings, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

The previous description of the disclosed aspects is provided to enable any person skilled in the art to make or use embodiments of the presently claimed invention. Various modifications to these aspects will be readily apparent to those skilled in the art, and the generic principles defined herein may be applied to other aspects without departing from the spirit or scope of the invention. Thus, the presently claimed invention is not intended to be limited to the aspects shown herein but is to be accorded the widest scope consistent with the appended claims and their equivalents.

I claim:

1. A tent, comprising:

a side-pull hub including:

an upper hub element;

a lower hub element include a palm grip feature at a bottom end of the lower hub to allow a user to grasp the hub during erection of the tent;

a pull-cord having a first end attached to the upper or lower hub element internal to the side-pull hub, and a second end fed through an opening in the top of the side of the lower hub element to allow user actuation of the side-pull hub by pulling the second end of the pull-cord to move the upper hub element and the lower hub element together; and a pulley mechanism internal to the side-pull hub including a plurality of pulleys through which the pull-cord is fed to provide mechanical advance during actuation of the pull-cord;

a plurality of tent support poles movably coupled to the side-pull hub; and a fabric material coupled to the tent support poles, the fabric material positioned below the side-pull hub and inside the tent support poles when the tent is in an erected position;

wherein the tent is erected by moving, from a user position exterior to the tent and exterior to the volume enclosed by the tent fabric, the upper and lower hub element together through user actuation of the pull-cord.

2. The tent of claim 1, wherein one or both of the upper and lower hub elements include a palm grip including a circumferential rounded groove to facilitate gripping of the hub during tent erection and/or take-down.

3. The tent of claim 1, further including one or more joints each including a loop-shaped tie out, the joint(s) mechanically coupled between a plurality of tent support poles segments forming each pole of the tent.

4. The tent of claim 3, further including a guy line having a proximal end coupled to a tie out on one or more of the joints and a distal end for coupling to a ground stake or other ground or surface attachment element.

5. The tent of claim 3, further including a guy line having a proximal end coupled to the tie out and a distal end for coupling to a ground stake or other ground or surface attachment element.

6. The tent of claim 1, wherein a first plurality of the tent support poles is mechanically flexibly coupled to the upper hub element and a second plurality of the tent support poles are mechanically flexibly coupled to the lower hub element.

7. The tent of claim 1, wherein the upper hub element has a downward-oriented conical portion and the lower hub has a corresponding cavity shaped to match and receive the conical portion to hold the upper and lower elements together when the tent is in the erect position.

8. The tent of claim 1, further including:

a plurality of tent support poles coupled to the hub;

one or more expansion poles coupled to the hub; and a fabric material coupled to the tent support poles and/or the expansion poles.

9. The tent of claim 8, wherein the fabric material includes a core tent section and an expansion section.

10. The tent of claim 9, wherein the one or more expansion poles are coupled to the upper hub element and directed upward from the hub to support the expansion section of the fabric material at a height greater than or equal to the hub height when the tent is erected.

11. The tent of claim 1, wherein the hub includes a coupling connection for the one or more expansion poles and wherein the tent support poles are coupled to the upper and lower hub elements and the expansion poles are coupled only to the upper hub element.

12. The tent of claim 11, wherein the tent includes two expansion poles and the expansion section includes an opening and one or more windows.

13. A tent, comprising:

a side-pull hub including a pull cord having a distal end protruding through an opening in the hub, the opening having rounded or smoothed edges to reduce abrasion, and a proximal end coupled internally to the hub, the side-pull hub including a pulley mechanism including a plurality of pulleys internal to the hub through which the pull-cord is passed to provide mechanical advantage during user actuation, an upper hub element having a conical-shaped protrusion on a bottom side, a lower hub element, including the opening at the top with an upper cavity shaped to match and receive the conical-shaped protrusion to hold the upper and lower hub elements together when the tent is erected, and a palm grip feature on the bottom side to aid a user in grasping the hub during erection;

a plurality of tent support poles coupled to the hub, with a first subset of poles of the plurality of tent support poles mechanically coupled to the upper hub element and a second subset of poles of the plurality of the tent support poles mechanically coupled to the lower hub element;

a fabric material coupled to the support poles, the fabric material positioned below the side-pull hub and inside the tent support poles when the tent is in an erected position so that the tent is supported entirely through the hub and support structures positioned outside of the fabric material and external to the tent's enclosed area;

one or more joints each including a loop-shaped tie out, the joint(s) mechanically coupled between a plurality of tent support pole sections forming each pole of the tent;

a guy line having a proximal end coupled to a tie out on one or more of the joints and a distal end for coupling to a ground stake or other ground or surface attachment element;

wherein the tent is erected by pulling the distal end of the pull cord with one hand while grasping the grip feature with another hand to moving, from a user position exterior to the tent, to move the upper and lower hub element together upon user actuation.

14. The tent of claim 13, wherein the lower hub element palm grip feature includes a circumferential rounded groove to aid is grasping the lower hub during tent erection.

15. The tent of claim 14, wherein ones of the tent support poles include three or more sections coupled by the joints between each of the sections.

16. The tent of claim 14, wherein the joints comprise a TPU material.

* * * * *